US005716216A

United States Patent [19]

O'Loughlin et al.

[11] Patent Number: 5,716,216

[45] Date of Patent: Feb. 10, 1998

[54] SYSTEM FOR SIMULATING SHOOTING SPORTS

[75] Inventors: Robert M. O'Loughlin; Terry P. O'Loughlin; George R. Hull; Michael D. Miles, all of Portland, Oreg.

[73] Assignee: LightShot Systems, Inc., Portland, Oreg.

[21] Appl. No.: 753,537

[22] Filed: Nov. 26, 1996

[51] Int. Cl.[6] ..... F41J 5/08

[52] U.S. Cl. ..... 434/22; 434/21; 273/365; 273/371; 463/51; 463/52; 463/53

[58] Field of Search ..... 434/19–22; 273/362, 273/365, 371; 102/444, 446, 498; 42/96; 446/46–48; 267/139, 140; 463/2, 51–53; 473/570

[56] References Cited

U.S. PATENT DOCUMENTS

| | | | |
|---|---|---|---|
| 2,174,813 | 10/1939 | Younghusband | 240/6.41 |
| 3,471,945 | 10/1969 | Fleury | 35/25 |
| 3,502,333 | 3/1970 | Fleury | 273/101.1 |
| 3,510,965 | 5/1970 | Rhea | 434/21 |
| 3,798,834 | 3/1974 | Samuel | 446/67 |
| 3,938,262 | 2/1976 | Dye et al. | 35/25 |
| 4,015,897 | 4/1977 | Konoma et al. | 359/740 |
| 4,195,422 | 4/1980 | Budmiger | 434/22 X |
| 4,367,516 | 1/1983 | Jacob | 362/110 |
| 4,380,437 | 4/1983 | Yarborough, Jr. | 434/18 |
| 4,443,014 | 4/1984 | Kovit et al. | 273/363 |
| 4,478,581 | 10/1984 | Goda | 434/22 |
| 4,514,621 | 4/1985 | Knight et al. | 235/400 |
| 4,561,848 | 12/1985 | Freeny, Jr. et al. | 434/18 |
| 4,592,554 | 6/1986 | Gilbertson | 273/312 |
| 4,640,514 | 2/1987 | Myllala et al. | 434/22 X |
| 4,662,845 | 5/1987 | Gallagher et al. | 434/22 |
| 4,678,437 | 7/1987 | Scott et al. | 434/21 |
| 4,706,482 | 11/1987 | Barber | 73/49.8 |
| 4,761,907 | 8/1988 | De Bernardini | 42/106 |
| 4,830,617 | 5/1989 | Hancox et al. | 434/21 |
| 4,854,595 | 8/1989 | Eichweber | 273/312 |
| 5,153,375 | 10/1992 | Eguizabal | 102/530 |
| 5,174,581 | 12/1992 | Goodson | 273/363 |
| 5,194,006 | 3/1993 | Zaenglein, Jr. | 434/19 |
| 5,281,142 | 1/1994 | Zaenglein, Jr. | 434/19 |
| 5,429,359 | 7/1995 | Timperman et al. | 473/570 X |

FOREIGN PATENT DOCUMENTS

| | | | |
|---|---|---|---|
| 2429006 | 8/1976 | Germany . | |
| 3537323 | 4/1987 | Germany | 434/21 |
| 4033268 | 4/1992 | Germany . | |
| 2020398 | 8/1991 | Spain . | |
| 2115708 | 9/1983 | United Kingdom . | |
| 2138112 | 10/1984 | United Kingdom . | |

OTHER PUBLICATIONS

Advertisement in the Orvis Catalog entitled, "Laser Clays—Practice with Your Gun Indoors or Out!", Fall 1997.

(List continued on next page.)

*Primary Examiner*—Richard J. Apley
*Assistant Examiner*—John Mulcahy
*Attorney, Agent, or Firm*—Chernoff, Vilhauer, McClung & Stenzel

[57] ABSTRACT

A system for simulating shooting sports includes a non-projectile ammunition transmitter system that is retrofittable to any standard firearm having an ammunition chamber, a barrel, and a firing pin and a self-contained receiver system. The transmitter system includes an actuating beam cartridge and an adjustable beam choke. The beam cartridge includes a first actuating beam emitter responsive to the firing pin. The beam choke includes a second emission beam emitter responsive to the first actuating beam. The receiver system is a self-contained reusable target having beam sensors and hit indicators. The beam sensors are "triggered" when the emission beam "hits" or is "sensed by" the beam sensors. When the beam sensors sense the emission beam, they cause the hit indicators to indicate that the target has been "hit" by the emission beam. The target may also include at least one triggering motion detector that detects a triggering motion that is associated with the target being launched into the air.

46 Claims, 18 Drawing Sheets

OTHER PUBLICATIONS

"Laser Clays The 21st Century of Shooting Has Arrived!", Outdoor Edition, Orvis News, vol. XXXI—No. 3, May/Jun. 1996, Manchester, Vermont, 2 pages.

"Fox hopes for glowing review on new puck", newspaper article by Dusty Saunders, Rocky Mountain News Broadcasting Critic, at least as early as Nov. 26, 1996, 1 page.

"Shoot to Thrill with Lasersport, The Shooting Sport of the Century", Lasersport Advertisement, Intermark of Virginia Ltd., Cedar Crest, New Mexico, at least as early as Nov. 26, 1996, 2 pages.

"Laser Clays Fun Practice Inside or Out", advertisement for Clays Launcher, at least as early as Nov. 26, 1996, 1 page.

SYSTEM FOR SIMULATING SHOOTING SPORTS

BACKGROUND OF THE INVENTION

The present invention relates to a system for simulating shooting sports and particularly to a system for simulating shooting sports such as trap, sporting clays, and skeet shooting.

Shotgun competition came to the United States from England, where it began in the 18th century. The targets were live birds, released from small boxes or traps. "Trap shooting" became very popular and during the last half of the 19th century, challenge matches frequently attracted tens of thousands of spectators. But a dwindling supply of live birds, and growing public sentiment against using them for targets, spurred a search for other targets.

One such inanimate shotgun target system came from London in the mid-1800s and included 2¼-inch glass balls and a launching device or "trap" to launch them. Because the balls were thrown only a few feet straight up from the launching device there was no challenge for Americans weaned on wild game birds. The result was a rash of new patents to improve both glass balls and launching devices. Balls were colored for better visibility, roughened to minimize the glancing off of pellets, and feather-filled to appeal to live-bird shooters. Better launching devices were developed as well. Eventually the now common "dome-saucer" target, "bird," "clay pigeon," or "clay" was developed. Despite the fact that many different inanimate target designs were developed before and after the dome-saucer, none were as practical. Improvements have been made since then, but the basic target remains much the same.

Currently, about 750 million clay targets are launched in America each year. The most dominant consumers are trap shooters, but new shooting sports, especially sporting clays and five-stand, have had significant impact on clay bird consumption.

These "clay" targets have several significant disadvantages. First, they are made from materials such as calcium carbonate—limestone, pitch, and latex paint that are generally not bio-degradable or otherwise environmentally friendly. In fact, the waste from one year's worth of shattered clays would extend for more than 39,000 miles—more than 1½ times around the earth at the equator. Biodegradable targets made from environmentally friendly materials such as bird seed and sugar, such as the target disclosed in U.S. Pat. No. 5,174,581, have been largely unsuccessful because they do not withstand the force of being thrown from the launching device. Another reason biodegradable targets have been unsuccessful is that they tend to crumble when they impact projectile ammunition which does not provide the definite visual and audible indication of impact provided by the shattering of traditional clay targets.

Another problem with clay targets is that they are best used during the day. Using lights to illuminate existing outdoor shooting ranges could be distracting if illuminated unevenly. Making the targets reflective, such as the target suggested in U.S. Pat. No. 4,592,554 to Gilbertson, would not be practical because of the relative lack of light at night to reflect off the targets. Adding lights to clay targets would not be practical because it could complicate the process of manufacturing the clays, could change the dimensions of the clays, and could be prohibitively expensive since the clays are destroyed after one use. Using clay targets indoors is also problematic and generally requires extensive modifications and safety equipment.

Other problems with shooting sports are associated with the dangers caused by projectile ammunition or "shot." Projectile ammunition that is capable of breaking a target can also pierce human skin. Accordingly, many non-projectile systems have been developed. Most of these non-projectile systems involve using special firearms having integral light or laser mechanisms. Since most shooters prefer to use their own firearms so they can practice under consistent conditions, some non-projectile systems have been mounted above or below the barrel of a standard shotgun. This mounted system, however, does not simulate actual shooting conditions because it throws off the shooter's aim when the beam of light does not emanate from the barrel.

U.S. Pat. Nos. 3,471,945 and 3,502,333 to G. K. Fleury disclose a light-emitting shotgun cartridge or shell and an electronic trap and skeet target that solve many of the problems of previously known non-projectile systems. Particularly advantageous is the ability to use a light-emitting shell in place of a normal projectile bearing cartridge or shell without additional adapters or firearm modifications. Another advantage of the Fleury shell is that it incorporates a delay time to simulate the delay between projectile ammunition leaving the gun and hitting the target. Because of its primitive design, however, the Fleury shell has several significant disadvantages. For example, a flash lamp embodiment is only designed for a single use and a conventional bulb embodiment is only designed for use at a relatively short range. Another problem is that the light emitted from the shell is not modulated and therefore is indistinguishable from any other incandescent or fluorescent light source of similar or greater brightness. Yet another problem is that the light pattern is determined only by the barrel's inside diameter and cannot be shaped to match a projectile shot pattern. Finally, the demands placed on the battery by the Fleury shell drains available battery energy quickly.

The Fleury shell, discussed above, is meant to be used with the Fleury target. The Fleury target is a self-contained, reusable, light detecting target adapted to simulate the trap or skeet clay target. The Fleury target has a single photosensitive device to detect incident light and an alarm system to provide a visual indication of a target hit.

One problem with the Fleury target is battery life. To solve this problem Fleury provided two externally mounted switches. The power switch is turned "on" to provide power to the alarm and the photosensitive device. The alarm reset switch toggles the alarm system between manual and automatic reset. These switches, however, create additional problems. By being externally mounted, it is likely that the switches will be damaged upon launching or landing. Because the power switch must be manually turned off, power will drain from the batteries if the target is not manually turned off. If the alarm reset switch is set for manual reset, the alarm, which requires a relatively significant amount of power, will drain the battery until it is manually reset. However, because it is often difficult to verify a hit if the automatic reset option is used, the manual reset option is generally preferable to the automatic reset.

Another problem with the Fleury target is that it is difficult to determine if the target is "alive" or if it has been hit. This is because the Fleury target is dark both when it is completely off and also when it is ready to detect a light signal. It is difficult to determine whether the target has been hit because the lights, when used during daytime conditions, are poor visual indicators of a hit.

Yet another problem is that the Fleury target's photosensitive device is unable to distinguish between various bursts of light. Although ambient light might not trigger the photosensitive device, there are natural bursts of light in normal daylight that would trigger the photosensitive device. Also, other light sources, such as flashlights and flash bulbs, could easily trigger the photosensitive device.

Other patents, such as U.S. Pat. No. 4,678,437 to Scott et al., U.S. Pat. No. 4,367,516 to Jacob, U.S. Pat. No. 3,938,262 to Dye et al., U.S. Pat. No. 2,174,813 to J. L. Younghusband, and U.S. Pat. No. 4,830,617 to Hancox et al., disclose light and laser devices used to simulate shooting. These devices include various combinations of apparatus either mounted within the ammunition chamber, mounted within the barrel, mounted axially to the barrel, or a combination thereof. None of these devices, however, include a system that accurately simulates live ammunition shooting.

While some regard shooting sports as dangerous, environmentally unsound and hazardous to a shooter's health, shooting sports do serve a purpose. Shooting sports provide recreation for millions of recreational shooters who might otherwise shoot live prey. Shooting sports also provide a valuable means for police, military, and civilian gun owners to become familiar and proficient with their weapons. Shooting sports have also become a popular spectator sport as is evidenced by its popularity during the 1996 Olympic games.

What is needed, then, is a system for simulating shooting sports that provides a non-polluting, non-lethal, inherently safe, reusable, highly reliable, indoor/outdoor form of shotgun shooting simulation. Further, a system is needed that provides as much realism to shooting sports as possible. The system should be inherently friendly to first time users such as women and youth. The system should also simulate shooting sports as nearly as possible so as to provide educational opportunities therefor. Finally, the system should require minimal or no maintenance, set-up, or breakdown.

BRIEF SUMMARY OF THE INVENTION

A system for simulating shooting sports according to the present invention includes a non-projectile ammunition transmitter system and a self-contained receiver system. The transmitter system is adapted to fit any standard firearm having an ammunition chamber, a barrel, and a firing pin.

Preferably the transmitter system includes an actuating "beam" (or wave) cartridge and an adjustable "beam" (or wave) choke. The beam cartridge includes an actuating beam emitter which can be activated by the firing pin. Preferably the beam cartridge has dimensions substantially identical to the dimensions of standard projectile or shot cartridges and therefore fits into the ammunition chamber of a standard firearm.

The beam choke includes an emission beam emitter responsive to the actuating beam. When a firearm is "fired," the firing pin strikes the beam cartridge which emits a first or actuating beam or wave. The actuating beam activates the beam choke which emits a second or emission beam or wave. The beam choke may also include apparatus which can vary the size and shape of the emitted beam pattern. Preferably the beam choke is adapted to fit into the barrel of a standard firearm.

The receiver system is a self-contained reusable target having beam sensors and hit indicators. The beam sensors are "activated" or "triggered" when the emission beam "hits" or is "sensed by" the beam sensors. When the beam sensors sense the emission beam, they cause the hit indicators to indicate that the target has been "hit" by the emission beam.

The target may also include at least one triggering motion detector that detects a triggering motion such as acceleration, speed, vibration, or other significant movement that is associated with the target being launched into the shooting arena. The triggering motion detector, upon detecting a triggering motion, activates the beam sensors. The target may then indicate that it is active and that its beam sensors are receptive to the emission beam.

Preferably the targets have dimensions sufficiently similar to standard shooting clays so that the targets may be launched by traditional launching devices. An exemplary embodiment of the target includes two states: a first sleep state and a second enabled state. In the sleep state the hit indicators are dark. In the enabled state the hit indicators may be lit or flashing. If only two states are used, the target is initially in the sleep state until it is triggered by a triggering motion. Once triggered, the target enters the enabled state. The target enters the sleep state after it has been hit by an emission beam or after an elapsed period of time.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
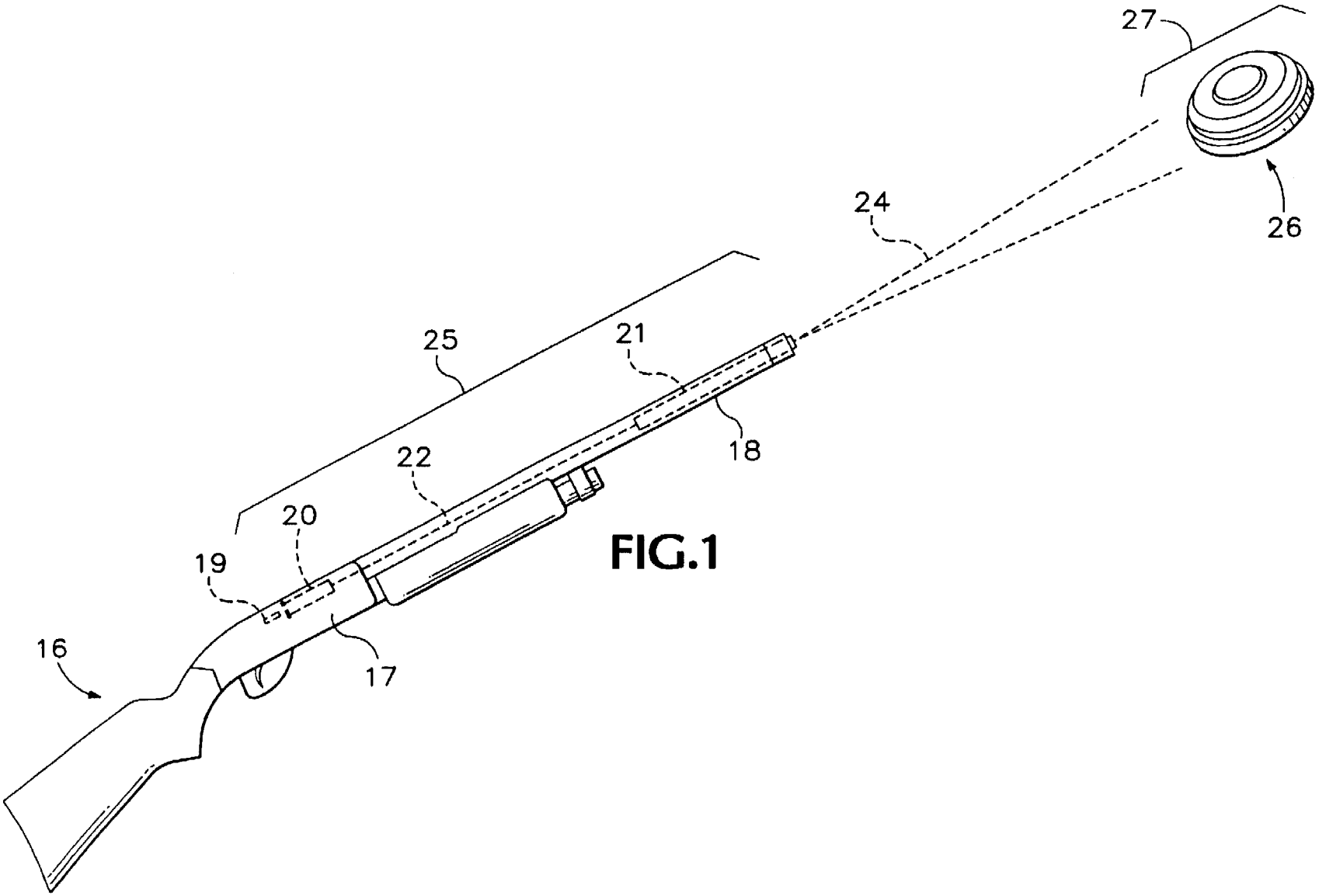
FIG. 1 is a plan diagram of a system for simulating shooting sports including a transmitter system and a receiver system.

As shown in FIG. 1, a system for simulating shooting sports of the present invention includes a non-projectile transmitter system 25 and a self contained receiver system 27. The transmitter system 25 is retrofittable to any standard firearm 16 having an ammunition chamber 17, a barrel 18, and a firing pin 19.

The transmitter system 25, as detailed in FIGS. 2–7*b*, preferably includes an actuating beam (or wave) cartridge 20 and an adjustable beam (or wave) choke 21. The beam cartridge 20 has dimensions substantially identical to the dimensions of standard projectile or shot cartridges and therefore fits into the ammunition chamber 17 of a standard firearm 16. The beam choke 21 is adapted to fit into the barrel 18 of a standard firearm 16. When a firearm 16 is "fired," the firing pin 19 strikes the beam cartridge 20 which emits a first or actuating beam (or wave) 22 (shown in phantom in FIG. 1) which may be any electromagnetic beam, but is shown as a beam of light. The actuating beam 22 activates the beam choke 21 which emits a second or emission beam (or wave) 24 (shown in phantom in FIG. 1) which may be any electromagnetic beam, but is shown in one embodiment as a laser beam and in another embodiment as a beam of light. Use of the actuating beam 22 as a link between the beam cartridge 20 and the beam choke 21 facilitates the use of the system with firearms of most barrel lengths. On the other hand, systems that use mechanical interconnections are limited by the length of the mechanical connection.

The receiver system 27, as detailed in FIGS. 8*a*–17 is a self-contained reusable target 26 having beam sensors 28 (FIG. 12) and hit indicators 30. The beam sensors 28 are "activated" or "triggered" when the emission beam 24 "hits" or is "sensed by" the beam sensors 28. When the beam sensors 28 sense the emission beam 24, they cause the hit indicators 30 to indicate that the target 26 has been "hit" by the emission beam 24. The targets 26 have dimensions sufficiently similar to standard shooting clays so that the targets 26 may be launched by traditional launching devices into the shooting arena. Traditional launching devices include, but are not limited to trap, skeet, sporting clay throwers, auto-rabbits, and hand throwing.

The Beam Cartridge

Figure 2A:
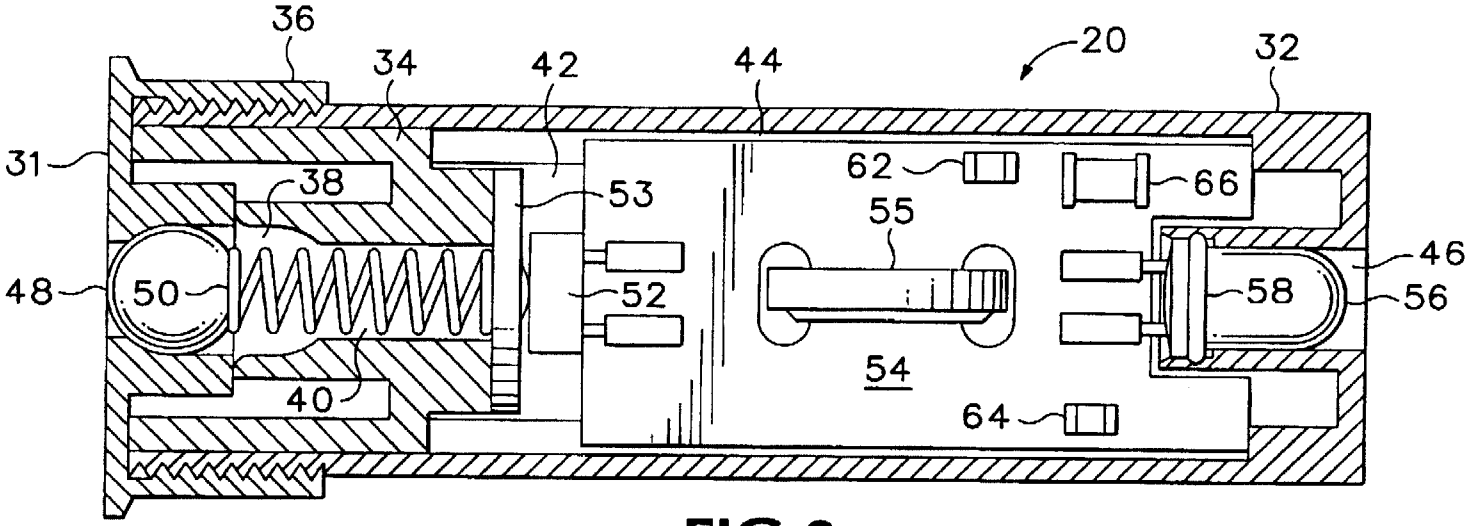
FIG. 2*a* is a cross-sectional side view of a beam cartridge.
Figure 3:
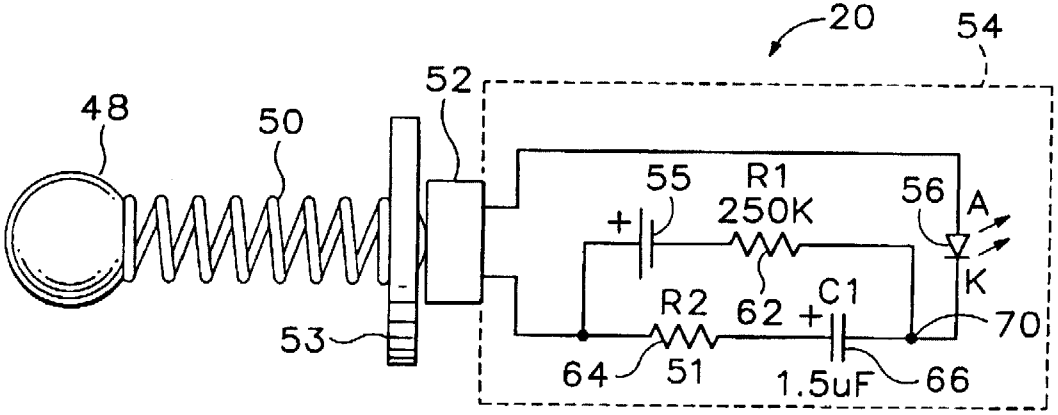
FIG. 3 is a diagram of the mechanical and electronic circuitry of the beam cartridge.
Figure 2B:
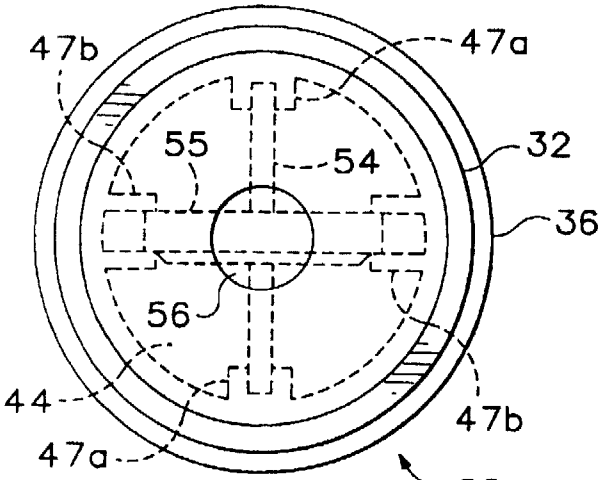
FIG. 2*b* is a cross-sectional front view of a beam cartridge.

The beam cartridge 20, as shown in FIGS. 2*a*, 2*b*, and 3, is designed to approximate the same external dimensions as a conventional ammunition or shot cartridge so that it can be loaded into the chamber 17 of a standard firearm 16 without modification. The beam cartridge 20 produces an actuating beam 22 such as a brief burst of light that travels down the barrel 18 of the firearm 16 when the firing pin 19 is released by the trigger and strikes the base 31 or rear of the beam cartridge 20. The actuating beam 22 is then used to activate circuitry in the beam choke 21, resulting in the emission of the emission beam 24 forming the link between shooter and target 26. The emission beam 24, as set forth above, may be any electromagnetic beam including a patterned burst of infrared (IR) energy.

The exemplary embodiment of the beam cartridge 20 shown in FIGS. 2*a* and 2*b* consists of a two-piece external case comprised of a tubular shell case 32 and an end cap 36 that forms the base 31. The case 32, 36 houses several mechanical and electrical interior components. The exterior dimensions of the case 32 can be adapted to accommodate any firearm 16 such as a 10-gauge, a 12-gauge, a 16-gauge, a 20-gauge firearm, 28-gauge firearm, or a 0.410-gauge firearm. As set forth above, the external case of the beam cartridge 20 consists of two external case components: a shell case 32 and a cartridge end cap 36 that forms the base 31 of the beam cartridge 20. The shell case 32 is made of durable material such as DELRIN™ or NYLON™. The cartridge end cap 36 screws on or otherwise joins with the shell case 32 at one end and may be easily replaced. The beam cartridge 20 also includes an internal case component, the spring guide insert 34, that fits in the shell case 32, 36 and has a central cavity 40 to enclose the spring. Together, the case components form five chambers or cavities: the sphere cavity 38, the spring cavity 40, the switch cavity 42, the cartridge printed wiring board (PWB) cavity 44, and the cartridge light- or laser-emitting diode (LED) cavity 46. As shown in FIG. 2*b*, the cartridge PWB cavity 44 preferably includes longitudinal board guides 47*a* and battery guides 47*b*.

FIG. 2*a* shows an exemplary beam cartridge 20 adapted to fit a 12-gauge firearm 16. As shown, the beam cartridge 20 would preferably include a sphere cavity 38 is shaped to allow a ¼"-diameter ball or firing sphere 48 to be retained in the sphere cavity 38, yet travel 0.200" when struck by the firing pin 19. The sphere cavity 38 is formed generally within the cartridge end cap 36 and the spring guide insert 34. It should be noted that the firing sphere 48 preferably has a spherical shape so that it may rotate in the sphere cavity 38. Since the firing sphere 48 rotates, the firing pin 19 is less likely to hit the firing sphere 48 in the same place causing undesirable deformation. The ends of the sphere cavity 38 are shaped to absorb the shock of the firing sphere 48 hitting the ends of the sphere cavity 38 after the firing sphere 48 has been struck by the released firing pin 19. This excess force is transferred to and absorbed by the case 32, 36 and the spring guide insert 34.

The spring cavity 40 formed in the spring guide insert 34 is approximately 0.188" in diameter by 0.363" long. A 0.625" spring 50 is located in this area with the excess spring length protruding into the sphere cavity 38. When the firing sphere 48 is in place, the spring 50 is compressed about 0.050" ensuring that the firing sphere 48 is pressed against, and nearly flush with, the beam cartridge base 31.

To further protect the switch 52 from the force exerted by the firing pin 19, additional protection barriers such as an optional flex barrier (not shown) and a barrier nub 53 may be interposed therebetween. The barrier nub 53 may be formed from a cut-out end section of the spring guide insert 34. Preferably the cut-out barrier nub 53 has a diameter at least as large as the diameter of the spring 50. On the side of the barrier nub 53 opposite the spring 50 is a small protrusion that connects with the switch 52 when the barrier nub 53 is pushed forward. The barrier nub 53 protects the switch 52 from uneven edges of the spring 50 as well as absorbs some of the shock therefrom. If the flexible barrier is included, it may be interposed between the barrier nub 53 and the switch 52 for further protection. The flexible barrier may be a thin durable piece such as mylar-type plastic.

The switch cavity 42, as shown in FIG. 2*a*, accommodates an electrical switch 52 mounted to the edge of a cartridge printed wiring board (PWB) 54. The cartridge PWB cavity 44 has four sets of protruding guides 47*a*, 47*b* so as to support the cartridge PWB 54 and a battery 55 that is mounted perpendicular to the cartridge PWB 54.

Following the cartridge PWB cavity 44 is the cartridge LED cavity 46 which may be 0.250" in diameter by 0.400" in length. This cartridge LED cavity 46 offers clearance for the edge mounted cartridge LED 56. An O-ring 58 surrounding the cartridge LED 56 may also be included to give a water resistant seal.

The beam cartridge 20 is preferably constructed by assembling the switch 52, cartridge PWB 54, and cartridge LED 56 and sliding the assembly into the shell case 32 using the guides 47*a* and 47*b* for alignment. Next is the barrier nub 53. The spring 50 and the firing sphere 48 are then placed into the spring guide insert 34. The optional flex barrier (not shown) and spring guide insert 34, along with the components therein, are then slipped into the shell case 32. The cartridge end cap 36 is then pressed or screwed onto the end of the shell case 32. This configuration traps the firing sphere 48, spring 50, and barrier nub 53. Removing the cartridge end cap 36 allows the firing sphere 48, the spring 50, barrier hub 53, the battery 55, and/or the cartridge end cap 36 to be easily replaced.

The beam cartridge 20 is preferably loaded into the firearm 16 just as any live cartridge would be loaded. Once in place, the spring 50 compresses as the firing sphere 48 is pushed violently forward by the firing pin 19. The length of the sphere cavity 38 allows the firing sphere 48 to travel forward after it is struck by the firing pin 19 before being stopped at the end of cavity 38. As the spring 50 compresses, it pushes against the barrier nub 53 and flexible barrier. The barrier nub 53, in turn, pushes against the switch 52. This ball-spring-switch actuating configuration provides the versatility necessary to accommodate variations in distance and force applied by the firing pins of various standard firearms. The configuration also protects the switch 52 from the forces and momentum asserted by the firing pin 19.

Preferably, several precautions are made to ensure that the ball-spring-switch configuration described above is durable. For example, by slightly insetting the firing sphere 48, accidental activation can be avoided. By grinding the ends of the spring 50 flat and spot-welding closed the final coil on each end of the spring 50, the end coils do not become deformed by repeat impacts. Also, optional flexible barrier protects the interior of the beam cartridge 20 from dirt, water, or other contaminants.

The switch 52 activates the electronic circuitry associated with the cartridge PWB 54 which, in turn, activates the cartridge LED 56. An exemplary embodiment of the electronic circuitry on the cartridge 5 PWB 54, as shown in FIGS. 2*a* and 3, includes the battery 55, two resistors (R1 and R2) 62, 64, a capacitor (C1) 66, and the cartridge LED 56. The battery 55, which is preferably a 3-volt lithium coin cell, is cross mounted with the cartridge PWB 54 (FIG. 2*b*). As shown in FIG. 3, an exemplary connection scheme connects C1 66 in parallel with the battery 55 through the series-connected R1 62 and R2 64. R1 62 has a resistance of 250,000 ohms and R2 64 has a value of 51 ohms. When the battery 55 is first installed, C1 66 charges to approximately 3 volts in under one second through R1 62. The peak current drawn from the battery 55 is 12 micro amperes decaying to less than 1 micro ampere after C1 66 reaches full charge. The cathode (K) of cartridge LED 56 is connected to the junction 70 of R1 62 and C1 66. This junction 70 is charged to a negative 3 volts relative to the positive terminal of the battery 55. Switch 52 is connected to the positive terminal of the battery 55. The other side of the switch 52 is connected to the anode (A) of cartridge LED 56. When switch 52 is closed, cartridge LED 56 is placed in parallel with the series-connected C1 66 and R2 64. The stored charge in C1 66 is rapidly discharged through R2 64 and the cartridge LED 56, dropping from 3 volts to 1 volt at a 75 micro second time constant rate. The actual duration of the current flow is dependent on the length of time that the switch 52 is closed. In normal operation the switch 52 is closed at least 50 μS but may turn off and then on again as the firing sphere 48 and spring 50 recoil producing an intermittent IR emission.

The cartridge LED 56, such as Sharp type GL538Q, gives a brief pulse of 950 nm IR having a peak power of 1.8 mW and decaying with a 75 micro second time constant towards zero. Alternatively, a laser LED could be used. The emitted actuating beam 22 is guided by the barrel 18 and illuminates a photo diode 118 located at the rearward end of the beam choke 21.

Beam Choke

Like the chokes used with conventional firearms 16, a beam choke 21 is preferably seated at the front of the barrel 18 of the firearm 16. Preferably, the beam choke 21 would be separately attached to the firearm 16, however it may be built into the firearm 16 itself or built into the beam cartridge 20. Once in place, the portion of the of the beam choke 21 that protrudes from the barrel 18 preferably has an outside diameter approximately equal to that of the firearm barrel 18.

Figure 4:
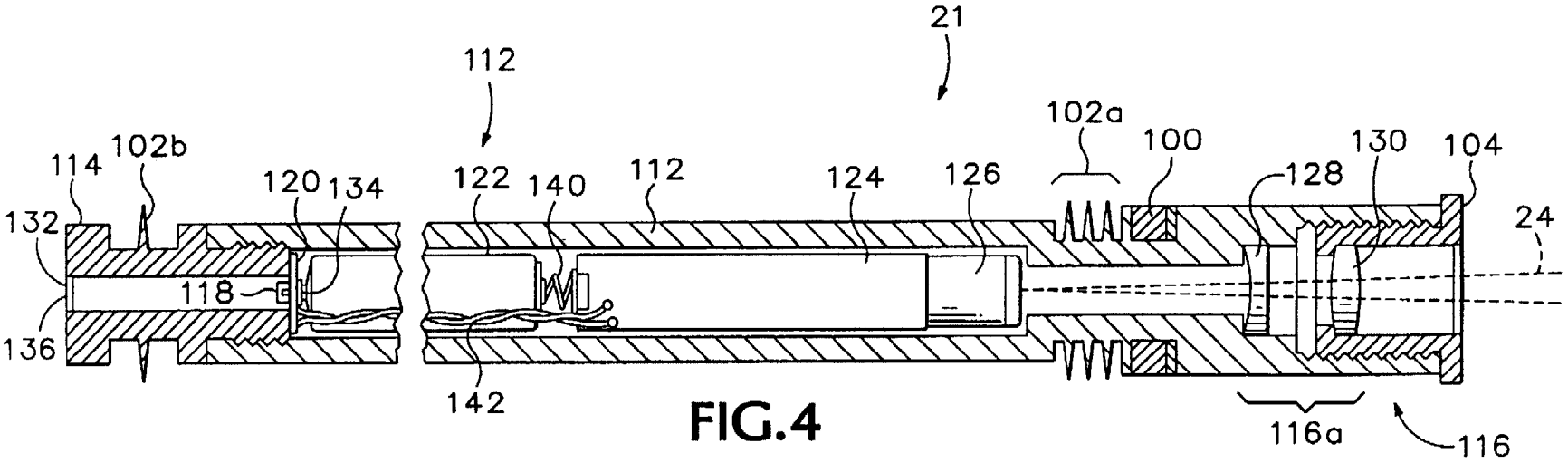
FIG. 4 is a cross-sectional side view of a beam choke including a variable choke grip.

One method that may be used to seat the beam choke 21 in the barrel 18 is to slip the beam choke 21 into the front of the barrel 18 or muzzle of a firearm 16 for which it is designed. FIG. 4 shows an exemplary beam choke 21 that uses magnetic and frictional forces to hold the beam choke 21 in the barrel 18. Embedded magnets 100 with a backing washer and flexible fins 102*a* and 102*b* may be used to further hold the beam choke 21 in place. The magnets 100 are preferably of a size and strength sufficient to retain the beam choke 21 within the barrel 18. One exemplary magnet 100 is a neodymium-iron-boron magnet with an internal remnant field strength of 12,300 Gauss which can be purchased from the Magnet Sales & Manufacturing Inc. in Culver City, Calif. In addition to providing a frictional force for holding the beam choke 21 within the barrel 18, the flexible fins 102*a* and 102*b* also assist in centering the beam choke 21 within the barrel 18. Preferably they are large enough to reach the maximum inside diameter of the barrel 18 and flexible enough to conform to the minimum barrel diameter (including constriction due to any mechanical choke contained in the barrel). The minimum and maximum diameters would vary depending on the gauge of the firearm. The flexible fins 102*a* and 102*b* may be made of a silicon rubber or other non-metallic, moldable, oil resistant material. It should be noted that embodiments may be constructed that use either magnets 100 or flexible fins 102*a* and 102*b*. Finally, it should be noted that use of magnets 100 and flexible fins 102*a* and 102*b* would be inappropriate to chokes used with projectile ammunition because the force of the projected ammunition would push a choke held by these apparatus out of the barrel of a firearm.

In the embodiment shown in FIG. 4, the beam pattern is controlled by a rotating variable choke grip 104. As will be discussed below, rotating the variable choke grip 104 causes the converging lens 130 fixed thereon to be moved towards or away from a diverging lens 128 fixed to the main choke body 112. Markings on the perimeter of the variable choke grip 104 and the choke body indicate standard choke pattern settings.

Figure 5:
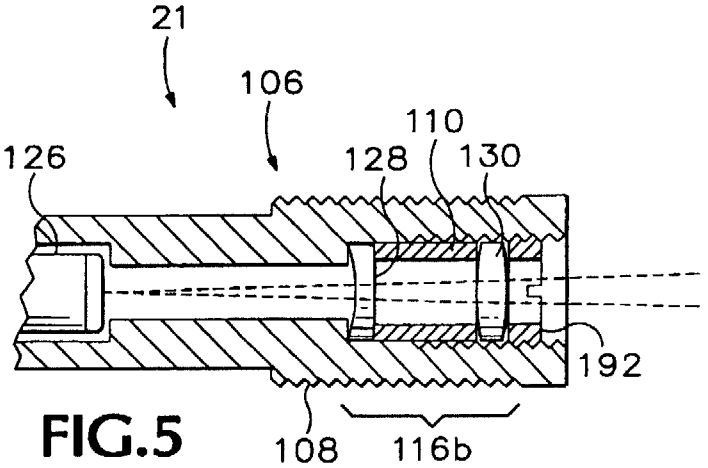
FIG. 5 is a cross-sectional side view of an alternate embodiment of the lens system.

The beam choke 21 may also be seated by being screwed into the barrel 18. More specifically, FIG. 5 shows an alternate embodiment of beam choke 21 that includes an exterior surface with threads 108 that mates with and is held in position by threads found at the muzzle end of standard replaceable choke firearms. As shown, the thread zone 108 on the outside diameter of the beam choke 21 has, for example, 32 threads per inch (TPI). A 32 TPI thread zone 108 with an outside diameter of 0.818 inches would accommodate most popular brands of replaceable choke firearms. This embodiment provides the equivalent of mechanical screw in replaceable chokes.

Yet another method of seating the beam choke 21 is to internally or externally clamp it to the barrel 18. This embodiment is not shown, however, it would require a clamping mechanism for holding the beam choke 21 in place.

Also like conventional chokes, the beam choke 21 has the ability to expand or contract the size of the pattern of the beam emanating from the firearm 16. However, in the preferred embodiment, the beam choke 21, upon receiving a signal such as the actuating beam 22 from the beam cartridge 20, emits the emission beam 24 as well as provides beam focusing capabilities. The emission beam 24 emitted by the beam choke 21 is preferably a precisely timed series of IR pulses. The radiant pattern is shaped by the lens system **116*a* or 116*b*** to match firearm pellet patterns.

The exemplary beam choke 21 shown in FIG. 4 consists of a main tubular choke body 112, a choke end cap 114, electronic components 124 including an IR emitter 126, and a lens system **116*a* or 116*b*. The choke body 112 is preferably a cylindrical tube containing the majority of the mechanical, electrical, and optical parts. Some of the internal components may include a choke photo diode (choke PD1) 118 in a choke PD1 PWB 120, batteries 122, electronics on the main choke PWB 124, an IR emitter 126 such as a laser or LED, and a lens system 116*a* or 116*b* which includes a fixed lens 128 and a movable lens 130. Mechanical means in the choke body 112 may be used to define separate compartments for the battery 122, main choke PWB 124, IR emitter 126, and lenses 128, 130**.

Beginning first with the rearward end of the beam choke 21 closest to the ammunition chamber 17, the choke end cap 114 is preferably removable to allow access to the internal components, including the batteries 122, of the beam choke 21. The choke end cap 114 has a hole 132 that allows the actuating beam 22 to reach photo diode 118. Attaching the choke end cap 114 retains the choke PD1 PWB 120, containing the photo diode 118, and creates contact pressure on a spring metal battery contact 134. The choke end cap 114 may also include one or more flexible fins **102*b*. A clear cover 136 preferably seals the end of the choke end cap 114 to keep contaminants from entering through the hole 132**.

In the exemplary embodiment shown in FIG. 4, the choke PD1 118 detects the presence of the actuating beam 22. The choke PD1 118, the choke PD1 PWB 120, and the spring metal battery contact 134 are preferably electrically connected to the main electronics 124 of the beam choke 21 by a twisted pair of wires 142. The spring metal battery contact 134 connects the positive end of the battery 122 to the choke PD1 PWB 120 and changes the pressure point on choke PD1 PWB 120 from the center of the choke PD1 PWB 120 to the perimeter of the choke PD1 PWB 120. This transfers the pressure exerted by the choke end cap 114 directly to the spring metal battery contact 134 and subsequently to the battery 122. This exemplary configuration prevents the choke PD1 PWB 120 from being stressed at its center which can cause damaging stress to the leads of choke PD1 118.

As a protective measure, the beam choke 21 may include a battery polarity insulator (not shown) to prevent reversal of the batteries which could destroy the electronics on the main choke PWB 124. The battery polarity insulator may be a circular piece of non-electrically conductive fiber with a hole in the center that is attached to spring metal battery contact 134. The batteries 122 may be three AAA cells, however, alternate power supplies could be substituted.

Forward of the batteries 122 is a battery spring 140 which may be electrically connected to the end of main choke PWB 124. The battery spring 140 exerts pressure on the batteries 122 to ensure contact; takes up mechanical tolerances; and bridges the gap from the battery compartment to the main choke PWB compartment. By keeping the batteries 122 from resting directly against the main choke PWB 124 it is less likely that shock will be transmitted to the main choke PWB 124 as batteries 122 are dropped into place or in the event that the beam choke 21 is dropped.

All elements on the main choke PWB 124 are preferably powered continuously by the batteries 122 as there is no power switch. The selected CMOS devices draw less than 12 micro-amperes while waiting for an actuating beam 22 from the beam cartridge 20. A 38 KHz oscillator 162 (FIG. 6) runs continuously during all modes of beam choke 21 operation. Circuit elements will function correctly with battery voltages as low as 3 volts. Using components that are surface mount devices greatly reduces the size of the parts used. This reduced size permits the electronics to be slipped into the choke body 112 of firearm barrels 18.

Figure 6:
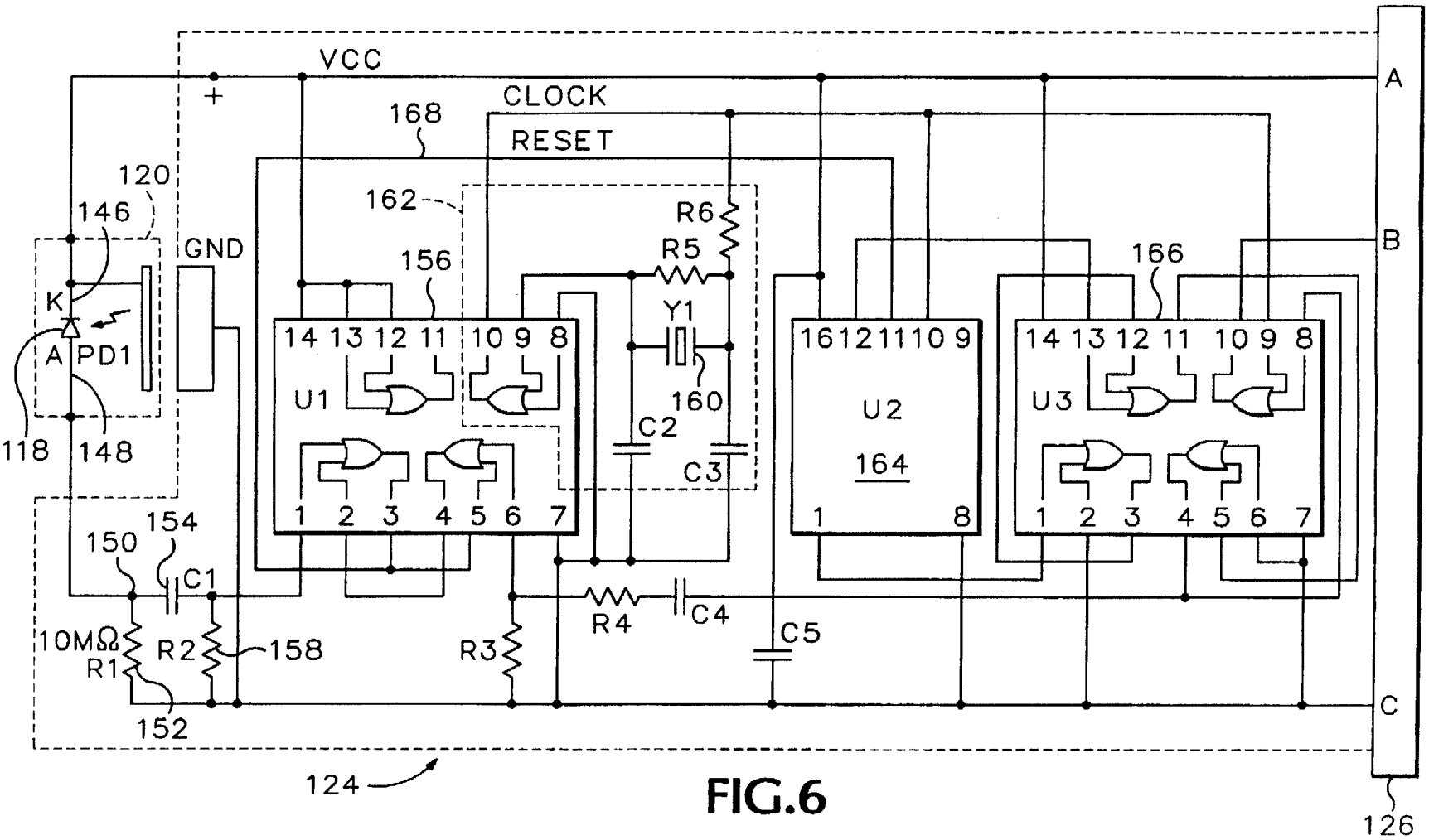
FIG. 6 is a circuit diagram of the electronics of the beam choke.

One exemplary embodiment of the electronics of a beam choke 21 is shown in FIG. 6. In this embodiment choke PD1 118 is a reversed biased silicon photo diode 118 such as BPW-34F which has a 800 nm to 1100 nm IR response. This photo diode 118 becomes conductive when exposed to the actuating beam 22. Detection of the actuating beam 22 is dependent upon the interior of the barrel 18 being dark such that the actuating beam 22 will significantly change the conduction of choke PD1 118. The cathode K 146 of choke PD1 118 is connected to the battery 122 positive terminal. The anode A 148 is connected to the junction 150 between R1 152 and C1 154. R1 152 pulls junction 150 to ground. R1 152 has a value of 10M ohms to ensure that small conduction changes in choke PD1 118 appear as a large change in voltage across R1 152. When choke PD1 118 conducts, junction 150 moves toward VCC. If the rate of movement is also fast (less than 820 uS), C1 154 transfers most of the voltage rise to U1 156 pin 1 across R2 158. When the voltage across R2 158 and U1 156 pin 1 reaches 80% or more of VCC, U1 156 pin 3 (the RESET line) will go Low.

U1 156, as shown, is a Quad NOR CMOS integrated circuit. Two of the NOR gates, pins 1–6, form a resetable latch so that if pin 1 goes High, the RESET line pin 3 will remain Low, until pin 6 goes High.

The third NOR gate in U1 156 (pins 8–10) and crystal Y1 160, as well as R5, R6, C2, and C3, are configured as a crystal controlled oscillator 162. The components are configured to produce exactly 180 degrees of phase inversion at the crystal frequency of 38,000.00 Hz causing U1 156 pin 10 to transition from High to Low exactly 38,000 times per second. The output of the 38 KHz oscillator 162, U1 156 pin 10, supplies clock transitions to U2 164 and U3 166. This oscillator 162 runs continuously to provide accurate timing clock transitions at all times, however, less than 7 micro-Amperes of battery current is drawn to sustain this continuous oscillation.

U2 164 is preferably a 4000 series, 14 bit CMOS binary divider such as DC4020BCM that contains 14 cascaded binary dividers. It takes the frequency of the oscillator 162 applied to U2 164 pin 10, and divides it by two from 1 to 14 times depending upon the U2 164 output pin selected. The dividing process only occurs when RESET at U2 164 pin 11 is Low. When RESET is High, all output pins are Low. U3 is interconnected with U2 so that exactly 512 38 KHz cycles are available at U3 166 pin 10. Together, U1 156, U2 164, and U3 166 insure that the delay, duration, and pulsing rate of the IR emitter 126 are exactly correct.

Figure 7A:
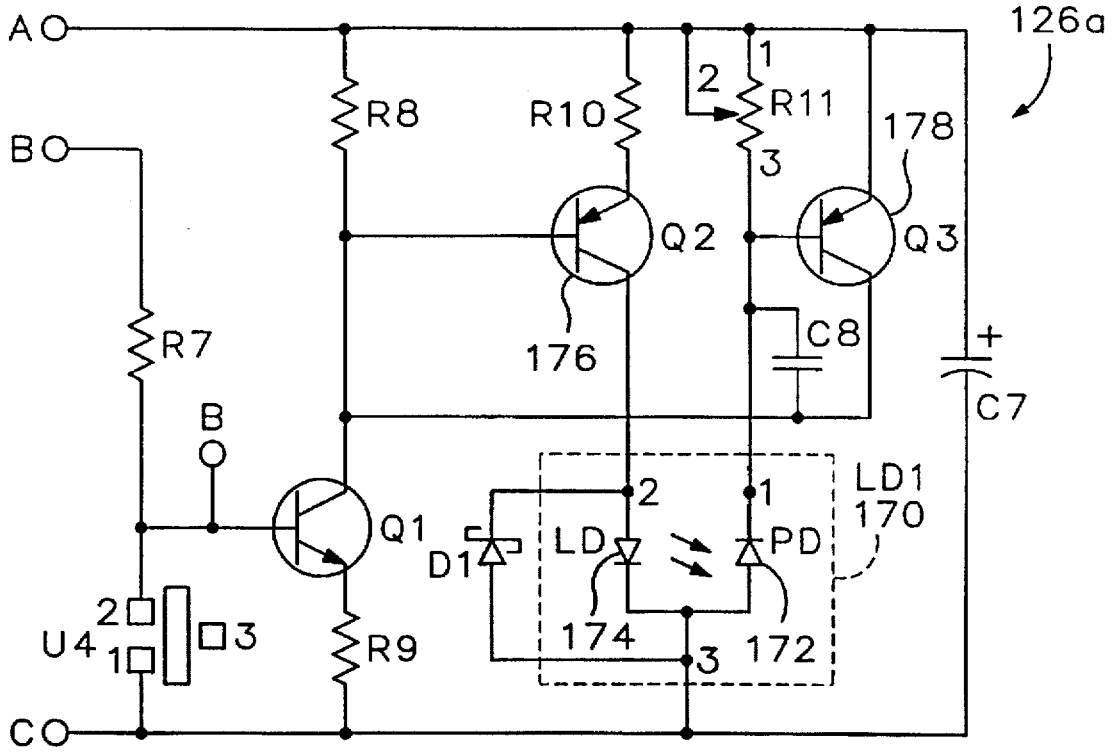
FIG. 7*a* is a circuit diagram of a laser drive circuit of the beam choke.
Figure 7B:
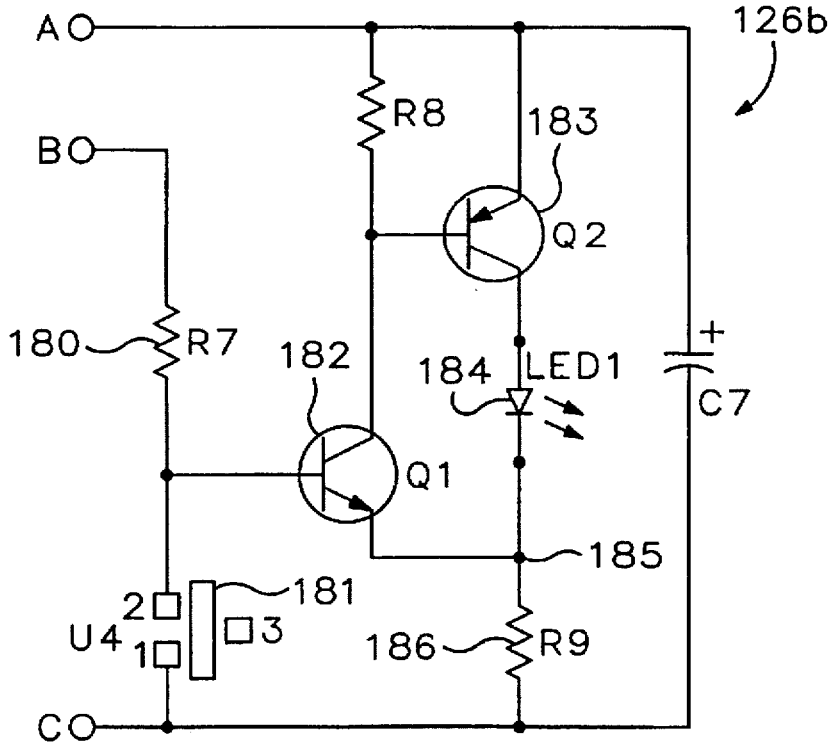
FIG. 7*b* is a circuit diagram of a LED drive circuit of the beam choke.

As shown in FIG. 6, the beam choke 21 includes an IR emitter 126 such as a laser drive circuit 126*a* (FIG. 7*a*) or a LED drive circuit 126*b* (FIG. 7*b*). Nodes A, B, and C of FIG. 6 interconnect with respective nodes A, B, and C of either FIG. 7*a* or FIG. 7*b*.

As shown in FIG. 7*a*, the laser diode drive 126*a* includes a laser diode LD1 170 such as ROHM RLD-85 PC. The current required to drive the LD1 170 to emit a specified amount of radiant power is a complex function of the laser threshold current, the current to radiant energy efficiency of LD1 170, and the ambient (and junction) temperature of LD1 170. A radiant energy-to-current converter within LD1 170 (a reversed biased silicon photo diode 172 located directly behind a laser diode die chip 174) supplies a conduction current proportional to the radiant energy output of the laser diode 174. The current conduction of the photo diode 172 is many times smaller than the drive current applied to LD1 170. The maximum radiant power output must not exceed 5 mW. As shown, LD1 170 is a Type P, 5.6 mm diameter, laser diode emitting 3 mW of laser power with an approximate wavelength of 850 nm and voltage drop of about 1.65 volts. Additional elements of LD1 170 may include a collimating lens, collimating lens adjustment, and laser module package.

To extend battery life it is desirable to completely turn off the laser diode LD1 170 between pulse peaks. This means that LD1 170 must turn on, then off for intervals of approximately 13 micro-seconds at an exact repetition rate of 38,000 cycles per second. U1 156, U2 164, and U3 166, as discussed above, insure that the delay, duration, and pulsing rate are exactly correct. Q2 176 and Q3 178 ensure that the current drive to LD1 170 stays within the required parameters to limit LD1 170 radiant output to approximately 3 mW. To verify the radiant output of LD1 170 it may be pointed at an instantaneous power indicating device so that all energy emitted by LD1 170 enters the device. R11 may then be adjusted until a peak power reading of 2.5 mW is indicated.

LD1 170 preferably emits a collimated circular laser beam. However, the radiant energy beam pattern emitted by laser diodes manufactured at this time all project an elliptical shape. Because shot patterns are circular, it is desirable to make the emitted beam more circular. Some possible methods of making the emitted beam more circular include: passing the beam through an aperture; passing the beam through a pair of angled prisms; placing a small correcting cylinder lens just above the laser diode emitting face; and collimating and modifying a beam with additional lenses. The embodiments discussed below in connection with exemplary lens systems 116*a* and 116*b*, include a beam that is collimated in the laser module using the collimating and modifying method.

The LED drive circuit 126*b*, as shown in FIG. 7*b*, includes R7 180 and U4 181 that convert the digital pulse burst into a low impedance, 1.3 volt peak amplitude voltage pulses. Q1 182 and Q2 183 form a non-inverting transconductance current amplifier forcing current through LED1 184 connected to the collector of Q2 183 and the junction 185 between the Q1 183 emitter and R9 186. The LED drive system 126*b* is very simple and allows higher peak levels of IR energy to be developed.

It should be noted that in using LED1 184, its radiating area may be too large for sufficiently small images to be created by compact lens assemblies. Accordingly, it may be desirable to control the image pattern by using lens focusing to make the image as small as possible and then placing restricting apertures at the surface of the LED. If the lens system is positioned to image the light at the aperture then the image size will vary as the aperture size varies.

Using the LED drive circuit 126*b* provides a low cost alternative to the laser drive circuit 126*a*. It also produces a round beam that does not require correction. Still further, there are no regulations defining and regulating LED emissions such as the Federal Laser Emission Regulations associated with the lasers. The LED drive circuit 126*b*, however, has several disadvantages including that the much larger object size makes the minimum diameter of the projected pattern many times larger than that produced by the laser drive circuit 126*b*. Also, when using a LED such as LED1 184, shown as Hamamatsu part L2791-02, the LED must be checked carefully to ensure that the center of the emission pattern is not occluded by a bonding wire.

Although either drive circuit 126*a* or 126*b* may be used, the IR emitter 126 must emit a beam of sufficient strength to trigger the beam sensors 28 in the target 26 after it has passed through the a lens system 116*a* or 116*b*. The lens systems 116*a* and 116*b* defuse the beam from the IR emitter 126 which, although it provides added safety for the user, necessitates that the beam sensors 28 be sufficiently sensitive to detect the diffused beam. As shown, photo diodes PD1–PD5 222*a–d* and 223 have a photo sensitivity of 0.5 Amperes per Watt when a 850 nm IR energy beam illuminates them.

The rotating variable lens system 116*a* shown in FIG. 4 is a variable lens system that can be used with either the laser drive circuit 126*a* or the LED drive circuit 126*b*. FIG. 5 shows an alternate lens system 116*b* that also can be used with either the laser drive circuit 126*a* or the LED drive circuit 126*b*. In both of these embodiments, the beam emitted by the IR emitter 126 is magnified by being passed through a diverging lens 128 and then a converging lens 130 to create a pattern in diameter (area) analogous to a pattern of projectile ammunition. FIG. 4 shows the spacing being adjusted by altering the position of a movable converging lens 130. FIG. 5 shows the spacing being adjusted by using shim spacers 110 of different lengths. The variation in the beam pattern is similar to the constriction caused by a mechanical choke at the end of the firearm barrel 18 that causes the pellets to strike a clay target in a pattern spread which has greater or fewer pellets per square inch.

As shown in FIGS. 4 and 5, the fixed lens 128 has a focal length of −24 mm and the second, movable lens 130 has a focal length of +36 mm. Using the approximate spacing of the two lens' focal points of approximately 13.2 mm (0.52") creates an effective focal length of −163 mm. This makes the image or pattern of the emission beam 24 emitted from the beam choke 21 35.9" across (a Full choke pattern) at a distance of 40 yards. If the space between the lenses is varied, or they are separated by appropriate length shim spacers 110, the desired image sizes can be obtained.

As shown in FIG. 4, a rotating variable lens system 116*a* includes a diverging lens 128 fixed to the main choke body 112 and a movable converging lens 130. The movable converging lens 130 moves towards oS away from the fixed lens 128 by rotating the variable choke grip 104 on coarse threads therebetween. Accordingly, the distance between the converging lens 130 and the fixed lens 130 is varied by rotating the variable choke grip 104. Such a variation sweeps the projected beam diameter from 18" to 45" at 35 feet. A mark on the stationary choke body 112 and marks on the rotating part allow calibration of "choke" settings.

FIG. 5 shows an alternate replaceable variable lens system 116*b* that also can be used with either the laser drive circuit 126*a* or the LED drive circuit 126*b*. The distance between the fixed diverging lens 128 and the converging lens 130 is adjusted by using replaceable shim spacers 110 of different lengths. More specifically, the IR emitter 126 projects a beam through the fixed diverging lens 128, the tube-shaped shim spacer 110, the converging lens 130, and a tube-shaped threaded retaining ring 192. To change the distance between the lenses 128 and 130, the threaded retaining ring 192 is removed so that the converging lens 130 can be removed. The tubeshaped shim spacer 110 is then removed and replaced with another tube-shaped shim spacer 110 having the desired length. The converging lens 130 and threaded retaining ring 192 are then replaced.

An additional feature of the transmitter system 25 is the delay time incorporated in the electronics of the beam choke 21 to simulate the flight time of projectile ammunition. This feature is necessary because the time it takes for an emission beam 24 to travel from the firearm 16 to the target 26 is significantly less than the time it takes projectile ammunition to travel from the firearm 16 to a clay bird. The present invention simulates the difference in flight time by adding a delay time between the time the beam choke 21 receives the actuating beam 22 and the time the beam choke 21 emits the emission beam 24. Further, with projectile ammunition, there is a spread between the individual shot pellets that are at the front of the pattern and the individual shot pellets that are at the back of the pattern. The present invention simulates the spread by increasing the duration of time that the emission beam 24 is emitted.

The exemplary circuitry, as shown in FIG. 6, delays the emission 0.054 seconds and emits the emission beam 24 for a duration of 0.0067 seconds. More specifically, U2 164 pin 12 divides the clock pulse provided by the crystal controlled oscillator 162 by $2^9$ (512) to make digital transitions occur every 6.737 mS. U2 164 pin 1 is connected to U3 166 pin 1 so as to cause U3 166 pins 3 and 12 to toggle between High and Low every 53.89 mS after RESET 168 goes Low. U3 166 pin 13 is connected to U2 164 pin 12 which transitions every 6.737 mS. Through a series of logic gates, these signals are connected so as to produce at U3 166 pin 10 a chain of 38 KHz digital pulses occurring 53.89 mS after RESET 168 goes Low and lasting for 6.737 mS. Accordingly, when the actuating beam 22 is received by photo diode PD1 118, RESET 168 goes Low. 53.89 mS after RESET 168 goes Low, U3 168 pin 10 emits a chain of 38 KHz digital pulses for 53.89 mS. These digital pulses activate the IR emitter 126. It should be noted that alternate delay times and durations could be accommodated. Further, the delay time and duration could be adjustable.

It should be noted that the components of the beam cartridge 20 and the beam choke 21 together comprise a transmitter system 25. Accordingly, one alternate embodiment includes the actuating beam 22 functioning as the emission beam that is sensed by the beam sensors 28. The beam choke 21 would be comprised of one or more optical lenses that could adjust the pattern of the actuating/emission beam. Alternately, no beam choke 21 would be needed if the beam pattern was not variable. Yet another embodiment could include a mechanical connection between the firing pin 19 and a beam choke 21.

Target

FIGS. 8–17 show a reusable target 26 that includes at least one triggering motion detector 200 (FIG. 12) that detects a triggering motion such as acceleration, speed, vibration, rotation, or other significant movement that is associated with the target 26 being launched or thrown from a launching device into a shooting arena. The triggering motion enables the target so that it is active and that at least one beam sensor 28 is receptive to an emission beam 24 from the transmitter system 25. If the beam sensor 28 senses an emission beam 24 it activates at least one hit indicator 30.

The exemplary target 26, as described below, is designed to provide immediate visual feedback to a shooter that he has hit the target. This feature distinguishes the invention from systems that require a shooter to look at a scoreboard or otherwise determine a "hit" or "miss" from a secondary source. Another feature of the exemplary target 26 is its durability that permits it to withstand the deceleration forces of landing and, therefore, is reusable. Yet another feature of the target 26 is its long battery life that permits multiple, reliable use without maintenance.

Figure 22:
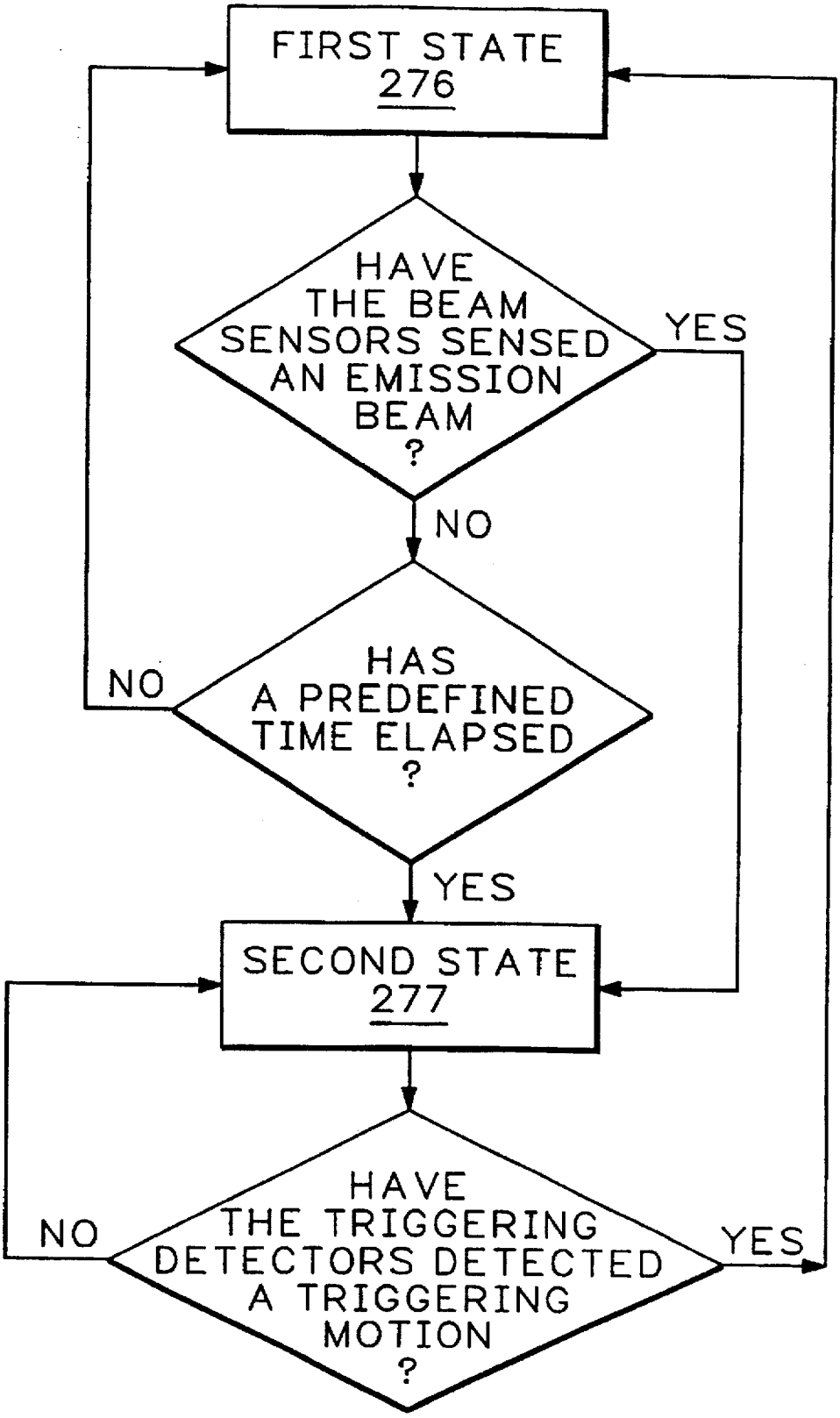
FIG. 22 is a flow chart of a two state embodiment of the target.

In practice, as shown in FIG. 22, the target 26 has at least two states: a first state 276 in which the hit indicators 30 are enabled and a second state 277 in which the hit indicators 30 are disabled. The target 26 initially is at rest in the second state 277. It changes from the second state 277 to the first state 276 when a triggering motion, such as the acceleration caused by being thrown from a launching device, is detected by the triggering motion detectors 200 of the target 26. Once triggered, one or more hit indicators 30 are enabled. The target 26 may change from the first state 276 to the second state 277 when the emission beam 24 is sensed by the beam sensors 28. Alternatively, the target 26 may change from the first state 276 to the second state 277 after a predefined time period (between 5 and 10 seconds).

Figure 23:
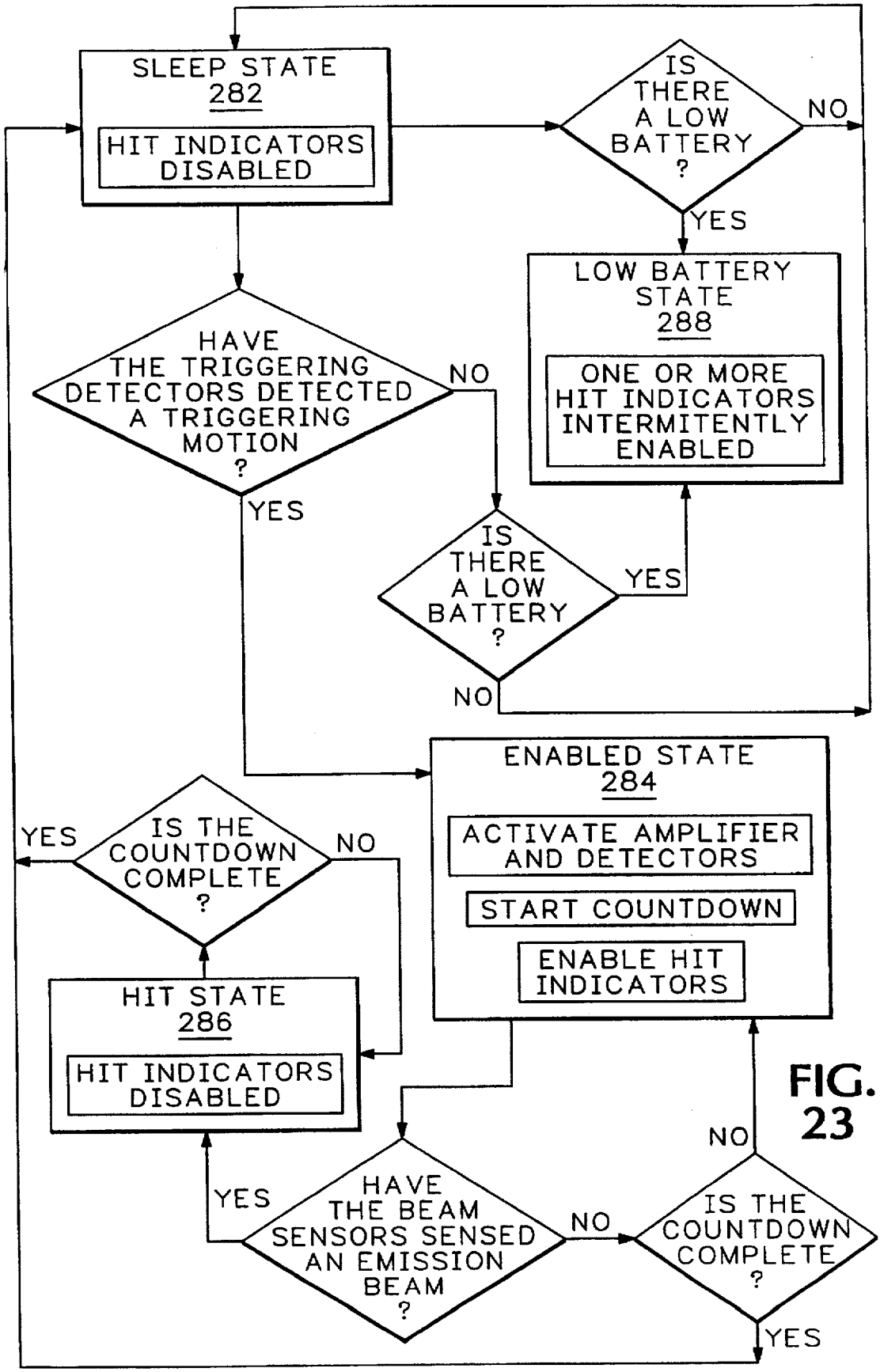
FIG. 23 is a flow chart of an alternate embodiment of the target's states.

As will be discussed below in detail, FIG. 23 shows five states of the target 26 as shown. The five states of being are as follows: (1) the "sleep" or rest state 282; (2) the "enabled" or awake state 284 in which the target is counting and the amplifier and detector unit 250 is active; (3) the "hit" state 286 in which an emission beam 24 with sufficient amplitude and duration has been sensed by the beam sensors 28; (4) the "low battery" state 288; and (5) the "+4 volt/amplifier test" state. The first four states are discussed below in connection with FIG. 23. These states may be visually indicated by any combination of dark, lit, or flashing hit indicators 30. Additional states may also be added. For example, the target 26 may have a state in which the hit indicators 30 are illuminated constantly to indicate either that the target 26 is set or that it has been hit. A "find" state could also be added that is initiated with an audible or light signal beam emanating from a remote control device to assist in finding the reusable targets 26 scattered about a field after they have been fired at and are laying at rest. Separate to or in addition to the visual hit indicators, audio hit indicators may be included in the target 26.

Turning first to the "sleep" state 282 shown in FIG. 23, the target 26 is at rest as it has not been activated by a triggering motion. No voltage is being generated by the triggering motion detectors 200. Also, the hit indicators 30 are preferably disabled or dark.

The target 26 is enabled or awakened into the "enabled" state 284 by a triggering motion such as an acceleration rate or vibration having a magnitude of more than 10 gravitational accelerations (10 g). In the "enabled" state 284 a triggering motion detector 200 that has detected a triggering motion produces a positive voltage equaling or exceeding a digital High that electronically signals the hit indicators 30 to indicate the target 26 is enabled, enables the +4 volt supply to activate the amplifier and detector unit 250, and starts a "countdown." To indicate that the target 26 is enabled, the hit indicators 30 may be constantly lit or may flash at a fast rate such as 22 Hz. The hit indicators 30 will indicate that the target 26 is enabled until the beam sensors 28 sense an emission beam 24 so that the target 26 enters the "hit" state 286 or the countdown is complete so that the target 26 returns to the "sleep" state 282.

Figure 12:
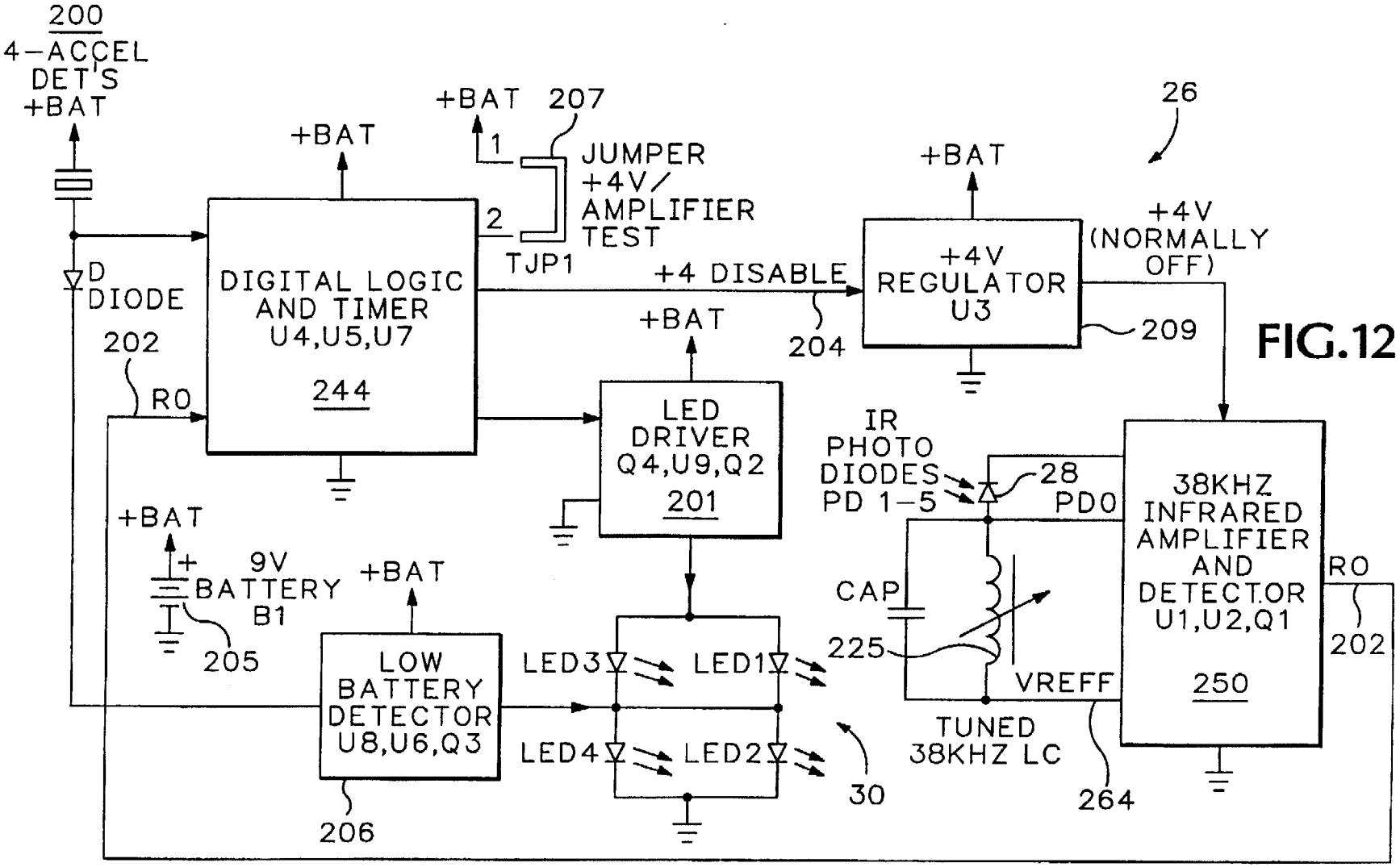
FIG. 12 is a block diagram of the electronic circuitry of the target.
Figure 15:
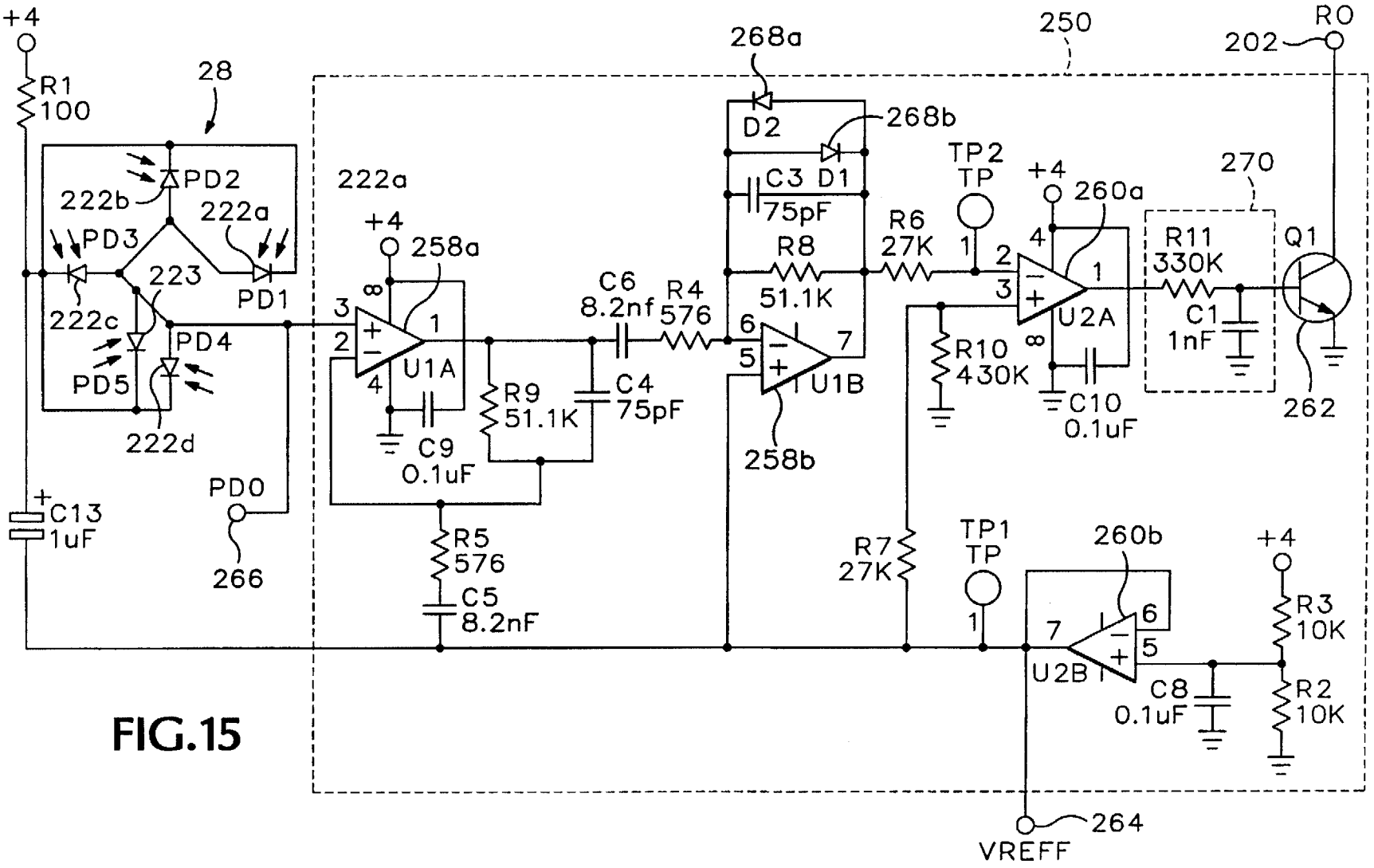
FIG. 15 is a circuit diagram of the beam sensors and amplifiers of the target.

The target 26 enters the "hit" state 286 when the beam sensors 28 sense an emission beam 24 of sufficient intensity and duration. As shown in FIGS. 12 and 15, this causes RO 202 to go Low and electronically signal the hit indicators 30 to indicate a hit, such as by going dark. If the RO goes Low, digital logic disables the +4 volt supply. In the "hit" state 286 RO 202 floats High since no conduction by Q1 262 is possible after the +4 volt supply is disabled. If the target 26 enters the "hit" state 286 prior to the counter completing its countdown, Reset 203 is Low, +4 volt disable 204 is High, and RO 202 is High. In the "hit" state 286 battery drain drops from 30 mA to 55 μA. Otherwise, the conditions of the "enabled" state 284 remain until the "sleep" state 282 conditions are reestablished. These conditions are significant because they ensure that the target 26 will not start another cycle either while in flight or during landing. Once the countdown is complete, the target 26 enters the "sleep" state 282. It should be noted that the predefined time marked by the countdown should exceed the anticipated target flight time so that the hit indicators 30 will remain lit through the flight unless it enters the "hit" state 286.

As shown in FIG. 284, if the beam sensors 28 do not sense an emission beam 24 and the countdown is not complete, the target 26 remains in the "enabled" state 284. However, if the beam sensors 28 have not sensed an emission beam 24 and the countdown is completed, the target 26 will return to the "sleep" state 282.

Figure 13A:
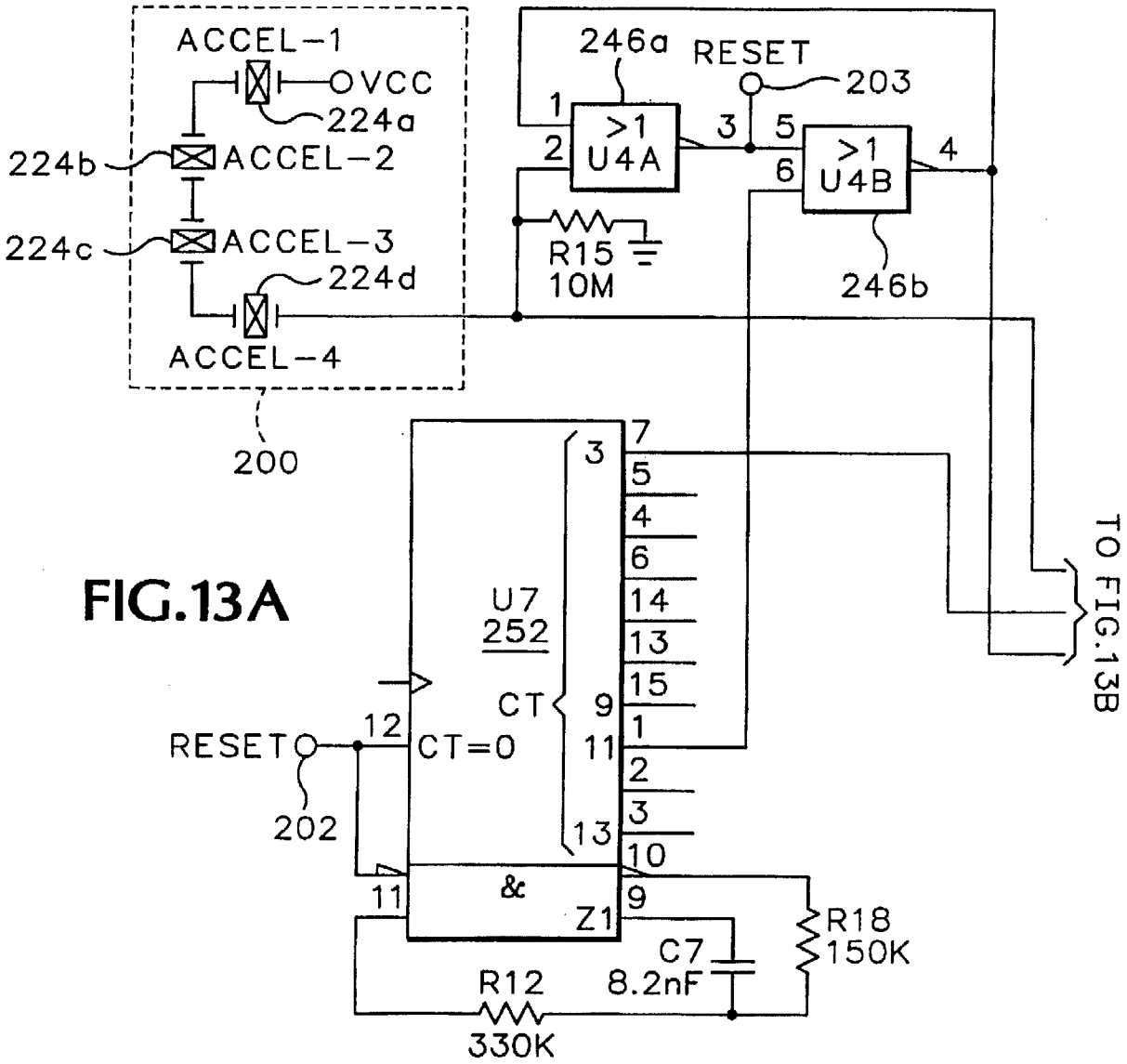
FIGS. 13*a–b* are a circuit diagram of the triggering sensors, hit indicators, digital logic, timer, and low battery detector of the target.
Figure 13B:
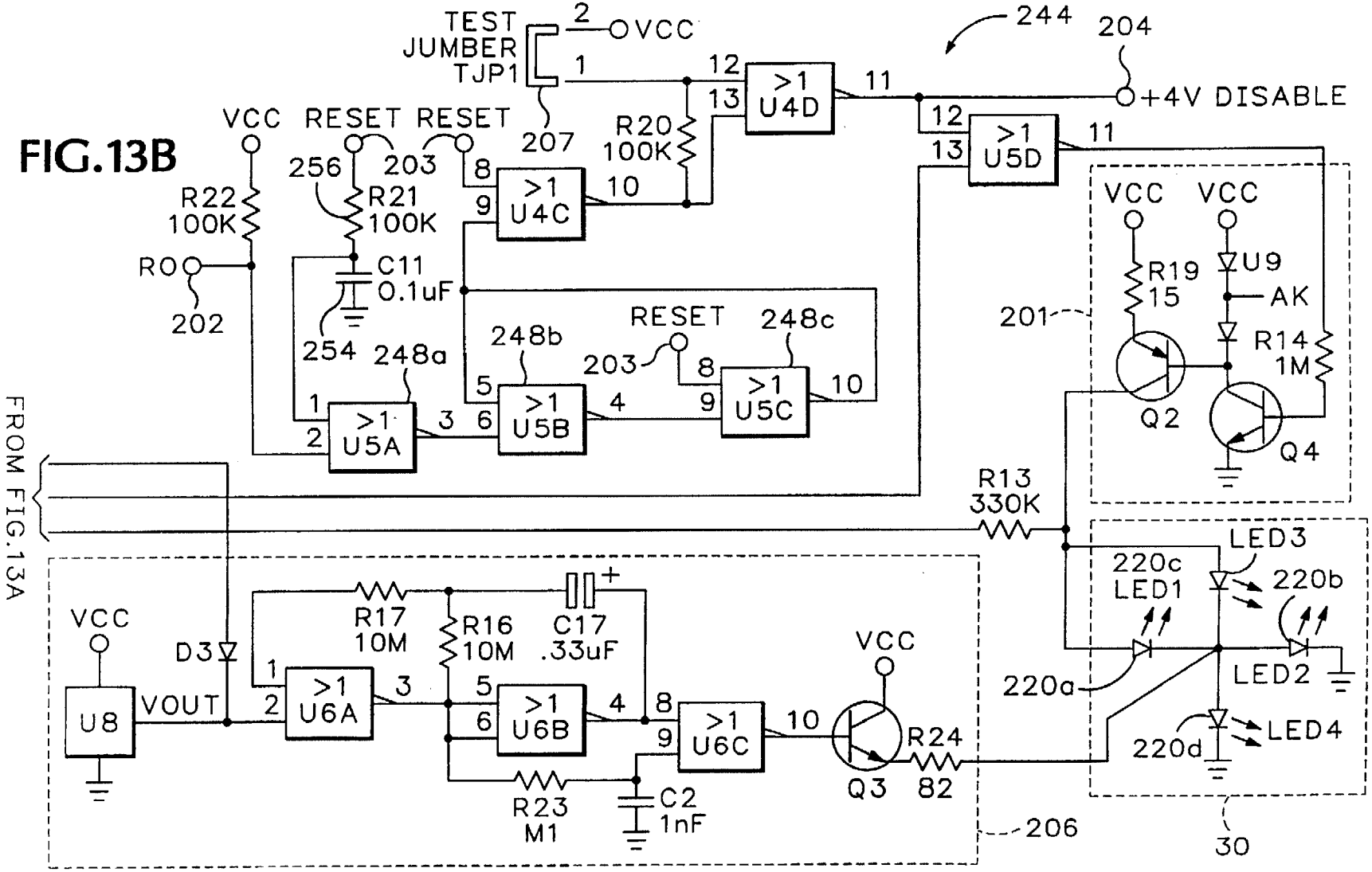
Figure 14:
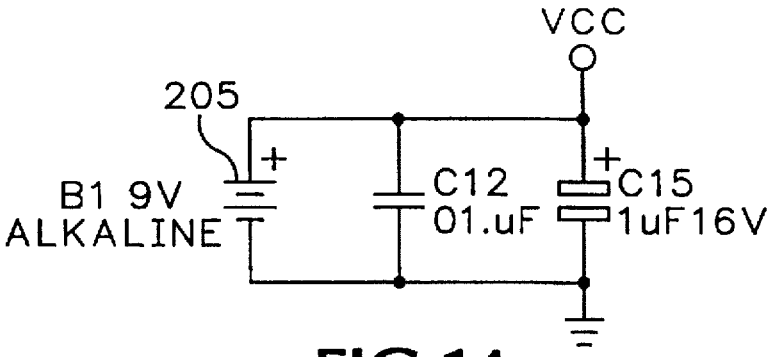
FIG. 14 is a circuit diagram of the power supply.
Figure 16:
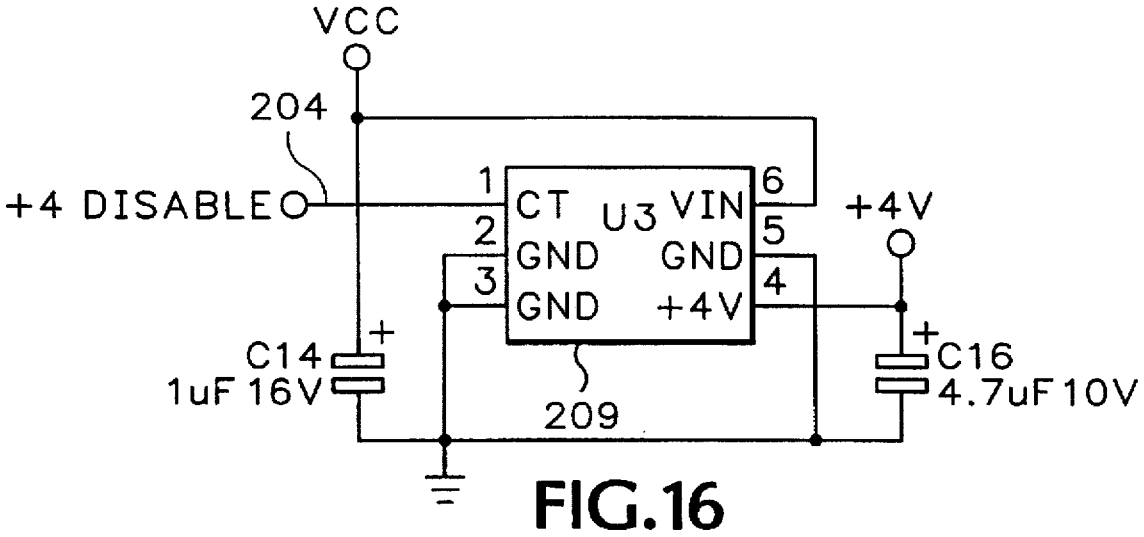
FIG. 16 is a circuit diagram of the battery regulator.

The "low battery" state 282 may be used to indicate when the battery 205 drops below 4.5 volts. This state may be represented by one or more hit indicators 30 flashing every few seconds. As shown in FIGS. 12 and 13, the input to the circuitry required to enable the target 26 is clamped Low to ensure that the target 26 cannot be awakened from sleep. The target 26 is disabled until battery B1 205 is replaced. It should be noted that, although it is not shown in FIG. 23, the "low battery" state 288 may be entered from any of the other states 282, 284, and 286. By using separate circuitry as shown in FIGS. 12 and 13, the target 26 will indicate it is in the "low battery" state 288 but will not interfere with the amplifier and detector unit 250 if the low battery condition occurs after the target 26 has entered the "enabled" state 284.

Yet another state, the "+4 volt/amplifier test" state (not shown), is used to test or tune the target's 126 circuitry to detect an emission beam 24 of a specific frequency such as 38 KHz. Although in the preferred embodiment this state would be entered only prior to the target's first use, or if the target 26 was being repaired, in alternate embodiments the circuitry would be easily adjustable so that targets 26 could be tuned to sense only the specific frequency emitted by the user's firearm. As shown in FIGS. 12 and 13, in this state a "test jumper" TJP1 207 is added to enable the +4 volt regulator supplying battery power to the amplifier and detector unit 250. In this state the amplifier and detector unit 250 can be tested and the L1 208 can be tuned. It should be noted that the +4 volt disable signal 204 is regulated by U3 209. Generally, the test jumper TJP1 207 is removed after testing is complete to reestablish minimum battery drain.

The target 26, as shown in FIGS. 8–11, includes five major components: a cover 210, a main circuit board 212, a chassis 214, a cushion ring 216, and a battery cover 218. Although not shown as a unit, the shown target 26 would be assembled so that the main circuit board 212 was enclosed within the cover 210, chassis 214, and battery cover 218. The cushion ring 216 would be held in place by the mechanical interconnection between the chassis 214 and the battery cover 218. The cushion ring 216 would provide added protection to the electrical components contained within the target 26.

Figure 8A:
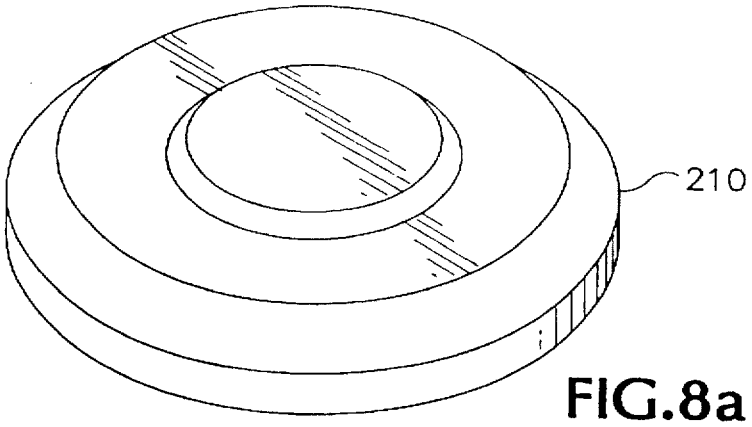
FIGS. 8*a–d* are top perspective views of the cover, main circuit board and chassis, cushion ring, and battery cover of the target case.
Figure 9A:
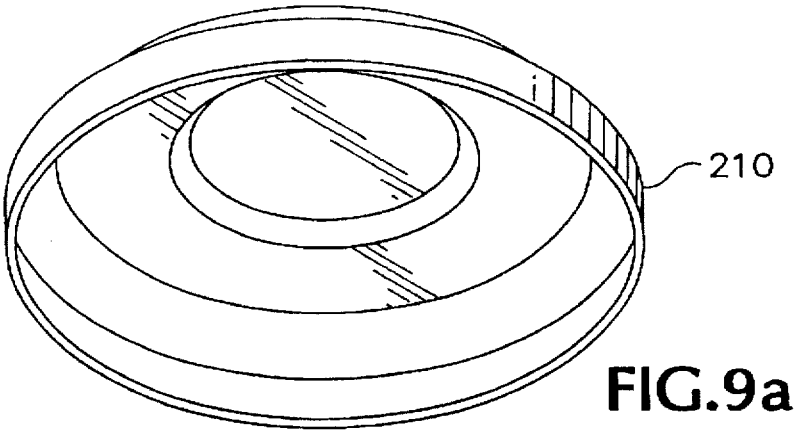
FIGS. 9*a–d* are bottom perspective views of the cover, main circuit board and chassis, cushion ring, and battery cover of the target case.

The cover 210, as shown in FIGS. 8*a* and 9*a*, is made from a durable material, such as molded plastic, and provides protection for the main circuit board 212. It is transparent to the emission beam 24 and to the light emitted by LED1–LED4 220*a–d*. The cover 210 may include a reflective coating that reflects light from a flashlight or search beam and thus can be used to find the target 26 after it is laying at rest. Preferably, the cover 210 is sealed to the chassis 214 by ultrasonic welding so that the internal components are protected from contamination.

The exemplary main circuit board 212, as shown in FIGS. 8*b*, 9*b*, 10, and 11 is a two-sided, four-layer, glass-epoxy, printed wiring board that provides support and electrical connection between the electronic components of the target 26. The electronic components mounted on the board 212 include the following: the beam sensors 28 shown as photo diodes PD1–PD4 222*a–d*; triggering motion detectors 200 shown as ACCEL1–ACCEL4 224*a–d*; and hit indicators 30 shown as LED1–LED4 220*a–d*. As will be discussed below, an additional beam sensor 28, shown as PD5 223 and a tuning board L1BOARD 225 are connected by wires to the main circuit board 212.

Figure 8B:
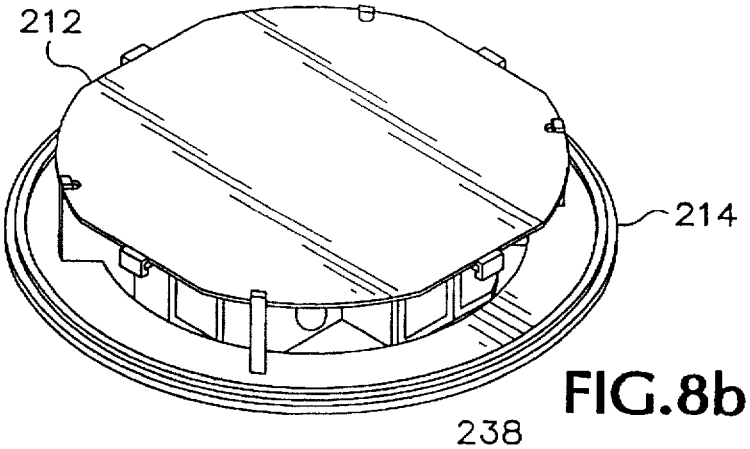
Figure 9B:
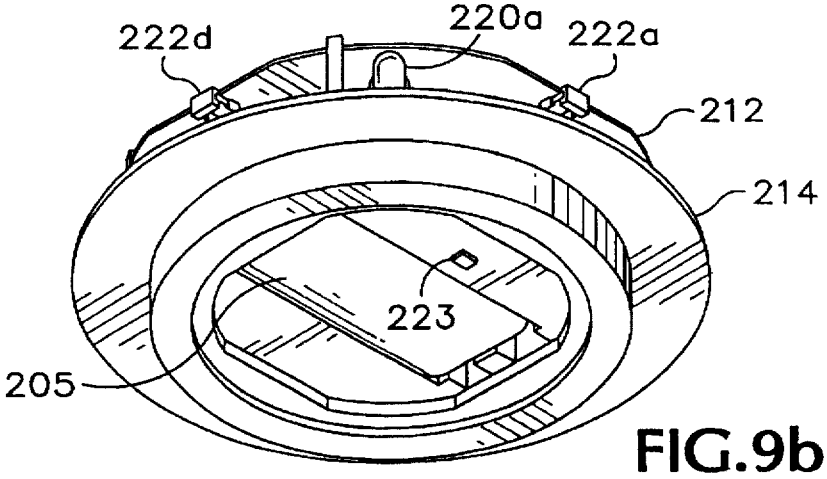
Figure 10:
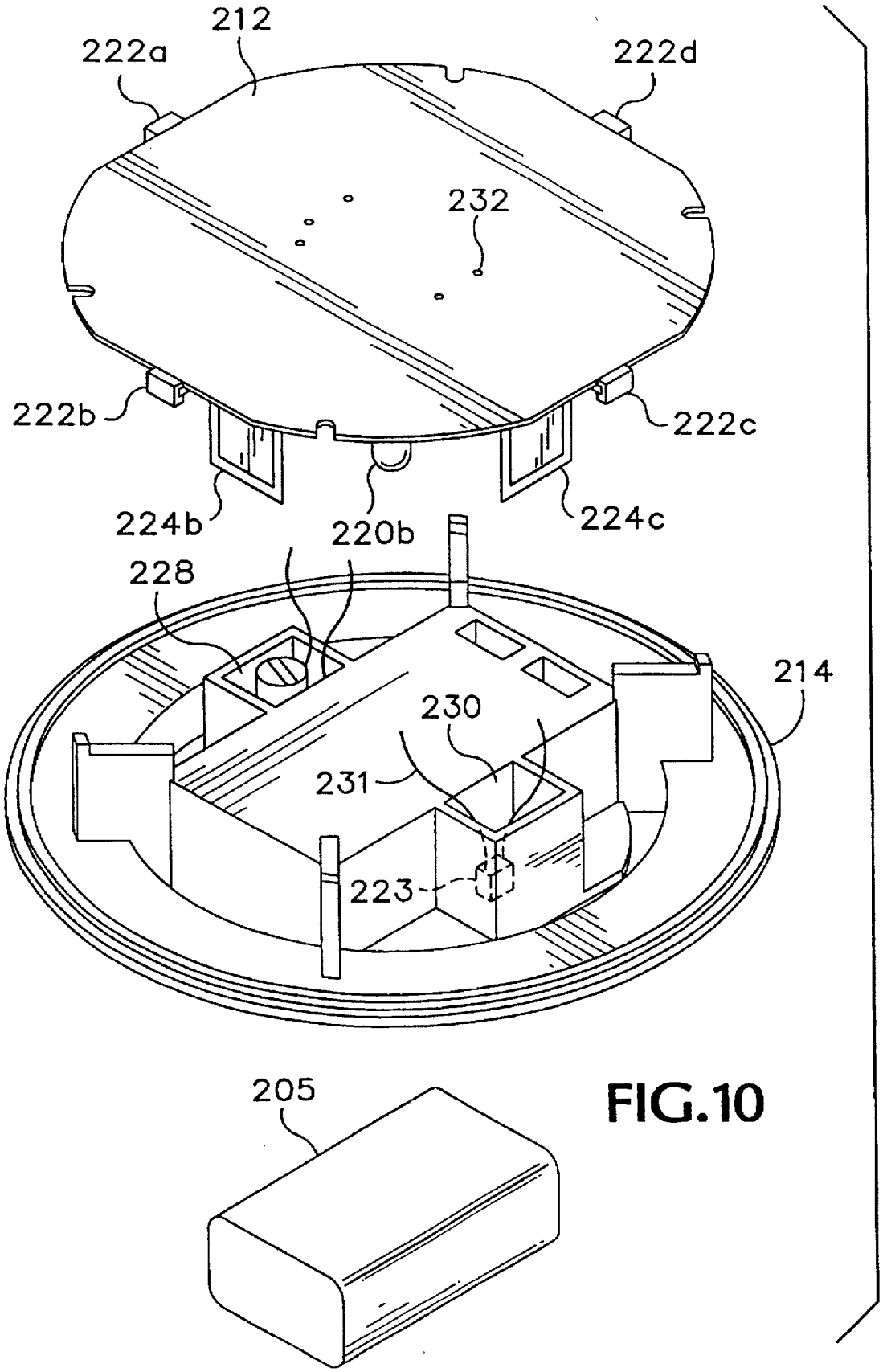
FIG. 10 is an expanded view of the main circuit board, chassis, and battery.
Figure 11:
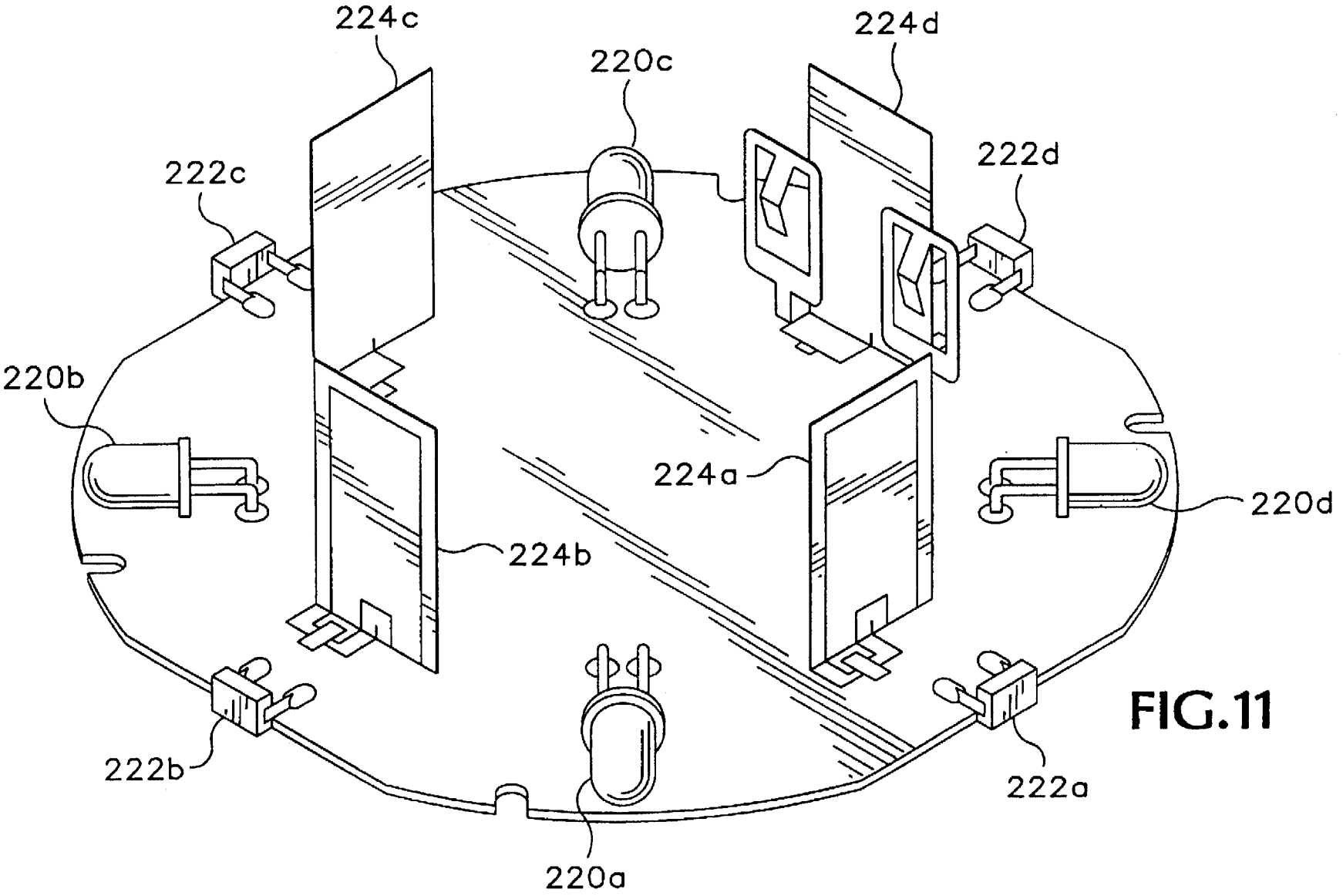
FIG. 11 is a bottom perspective view of the main circuit board with installed components.

The exemplary chassis 214, as shown in FIGS. 8*b*, 9*b*, and 10, is made from durable material such as molded plastic. The chassis 214 provides a mounting surface for the main circuit board 212 and forms the battery compartment 226, the back support for acceleration detectors ACCEL1–ACCEL4 224*a–d*, the attachment surface for the cover 210, the attachment surface for the cushion ring 216, and the mounting compartments 230, 228 for photo diode PD5 223 and small circuit board L1BOARD 225.

Figure 8C:
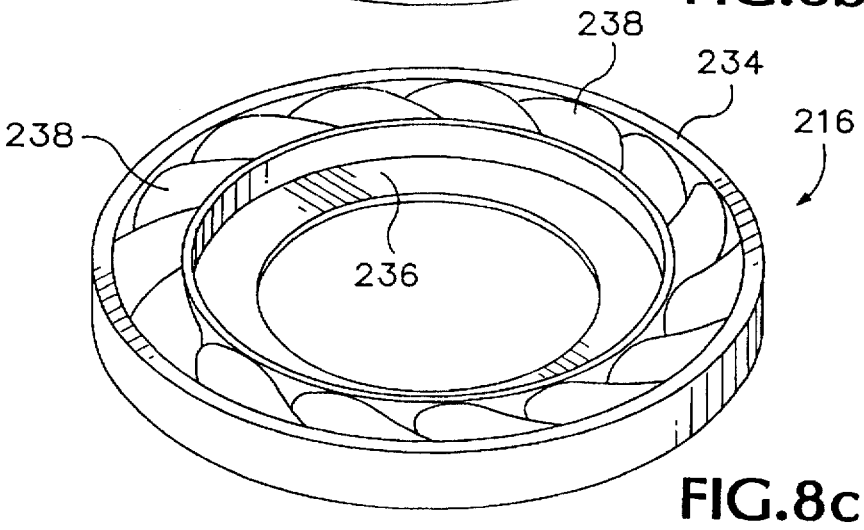
Figure 9C:
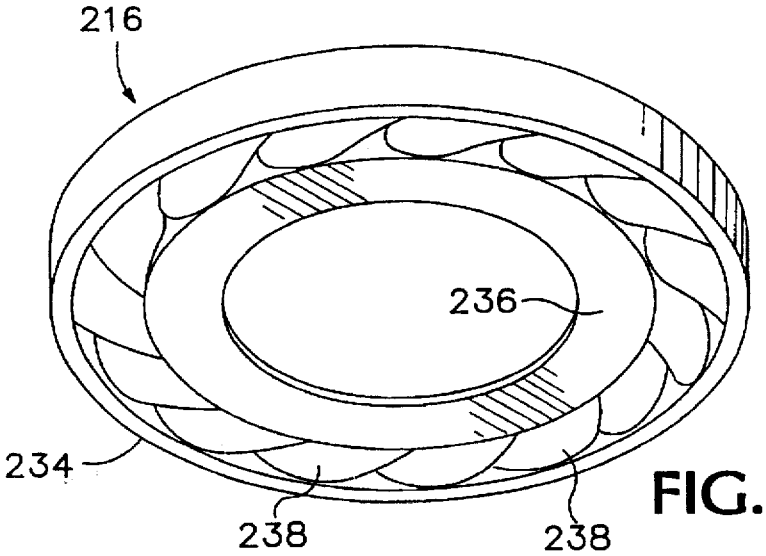

The exemplary cushion ring 216 shown in FIGS. 8*c* and 9*c*, is also made of durable and more flexible material such as molded plastic. Preferably, the cushion ring 216 is a single piece consisting of a circular outer ring 234 with an inner ring 236 joined by plurality of flexible braces 238. The inner ring 236 mates with the chassis 214 to provide an energy absorbing interface between the outer surface of the outer ring 234 and the chassis 214. This exemplary embodiment allows the outer ring 234 to deform so as to absorb shock and protect sensitive components located on the main circuit board 212 when the target 26 hits the ground, or another object, after launch. In standard operation the target 26 would preferably be caught in a net, but this feature protects the internal components of the target when it does not.

The cushion ring 216, as shown serves several purposes. As mentioned above, it absorbs shock and protects sensitive components. It also provides an annular surface having dimensions suitable to interact with the throwing arm of a trap. The braces 238 also act as cushions that compress and deflect the forces of landing.

Figure 8D:
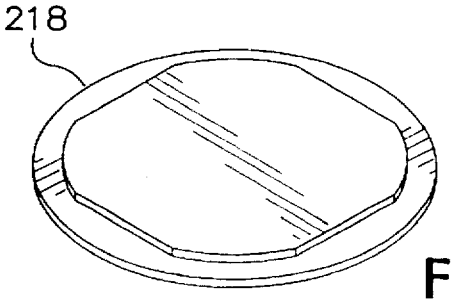
Figure 9D:
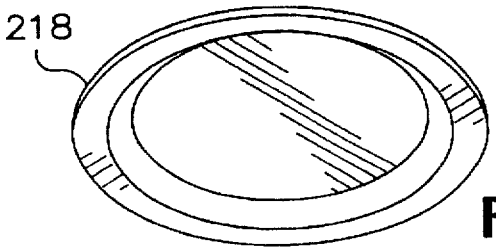

The exemplary battery cover 218 shown in FIGS. 8*d* and 9*d* is made from durable material such as molded plastic. The cover 218 provides access to the battery 205 in battery compartment 226 so that the battery 205 may be replaced when necessary. Because of the many battery-saving features of the present invention and the "low battery" state 288, battery replacement should be rarely necessary.

Figure 17:
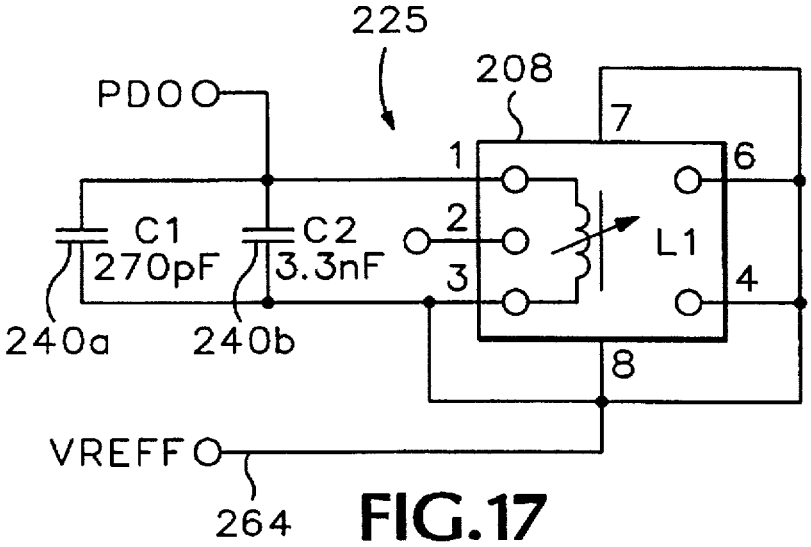
FIG. 17 is a circuit diagram of the tuning board L1BOARD.

As mentioned above, the tuning board L1BOARD 225 which is inserted into the L1BOARD mounting compartment 228 (FIGS. 19*b* and 10) is a small circuit board. FIG. 17 shows the circuitry of the variable or tunable inductor L1 208 and two capacitors 240*a–b* that comprise an LC parallel tuned, resonant circuit. As shown, the LC circuit is tuned to 38 KHz to detect the preferred emission beam 24. This circuit is preferably tuned while outside of the chassis 214 using a fixture with suitable electronic loading and display elements. After tuning, the L1BOARD 225 with connecting wires slides into the pocket or mounting compartment 228. The mounting compartment 228 may then be filled with epoxy giving rigid mounting support and generally disallowing further tuning of L1 208.

Photo diode PD5 223 is placed face-down in the mounting compartment 230 (FIG. 10) with two wires 231 extending through at least one through-hole site 232 for connection to the main circuit board 212. Epoxy may then be poured into the compartment 230 to secure PD5 223 and to provide a counter balance to the weight of the epoxy around the L1BOARD 225.

At final assembly the wires protruding from the two compartments 230 and 228 are electrically connected to the main circuit board 212 at through-hole sites. The main circuit board 212 is then secured to the chassis 214.

One exemplary embodiment of the circuitry for the target 26 is shown in FIGS. 12–17. FIG. 12 shows an overview of the exemplary circuitry in which four triggering motion detectors 200 signal a digital logic and timer unit 244 (shown in detail in FIG. 13) upon detecting a triggering motion. The digital logic and timer unit 244 then signals an LED driver 201 to activate the hit indicators 30 which indicate that the target 26 has entered its "enabled" state 284. Simultaneously, the digital logic and timer unit 244 activates the +4 volt regulator I.C. to supply power to the 38 KHz infrared amplifier and detector unit 250 enabling the beam sensors 28. If a beam sensor 28 senses an emission beam 24, a signal is sent through the amplifier and detector unit 250, digital logic and timer unit 244, and LED driver 201 to activates at least one hit indicator 30 and the target 26 enters its "hit" state 286.

More specifically, the target 26 is "set" by a triggering motion such as acceleration, rotation, or fast movement. The triggering motion is detected by triggering motion detectors 200 such motion or acceleration sensors such as the four series connected piezo polymer acceleration detectors ACCEL1–4 224*a–d* that are shown in FIG. 13. ACCEL1–4 224*a–d* are preferably made from thin plastic film/silver ink laminates that produce a voltage when bent. Each of ACCEL1–4 224*a–d* is mounted on each of the four radial direction faces of the target 26 chassis 214. When the target 26 is subjected to radial accelerations exceeding about 10 g (320 ft/sec$^2$) ACCEL1–4 224*a–d* can, if the direction of acceleration is suitable, deflect outward due to their own inertia and flexibility. As shown, each ACCEL1–4 224*a–d* is a 520 pF capacitor capable of generating 7 or more volts when subjected to the accelerations. The very high input impedance and approximately 5 pF of input capacitance of 4000 series CMOS logic of the digital logic and timer 244 is easily driven by the triggering sensors 200. Since ACCEL1–4 224*a–d* produce strain charge from mechanical deformation, no power is required to operate them, and they provide sufficient energy to enable the digital logic and timer unit 244.

The exemplary digital logic and timer unit 244, as shown in FIG. 13, includes three basic circuit components. The first component is a resettable latch, shown as U4A 246*a* and U4B 246*b*, that detects and holds any instantaneous incident whereby ACCEL1–4 224*a–d* generate a voltage constituting a digital High at U4A 246*a* pin 2. The second component is a resettable latch, shown as U5B 248*b* and U5C 24*c*, that detects and holds any instantaneous incident of the digitally conditioned output of U5A 248*a* that inverts and holds off (during transition from the "sleep" state 282 to the "enabled" state 284) RO 208 output of the amplifier and detector unit 250. The third component is the timer or counter U7 252, that is a resettable 14 bit binary divider/oscillator that is normally stopped until RESET 203 goes Low. When RESET 203 goes Low, timing components determine the frequency of oscillation. One digitally divided frequency output of U7 252 determines the rate at which the hit indicators 30 blink on and off. Another digitally divided frequency output of U7 252 determines the time period (countdown) which the target 26 remains in the "enabled" state 284.

It should be noted that U5A 248*a*, in the embodiment shown, serves the dual functions of inverting the normally High RO 202 to a digital Low and inhibiting response to RO 202 changes while the target 26 is awakening. U5A 248*a* pin 1 is held High by RESET 203 while the target 26 is in the "sleep" state 282 forcing the input to the receiver latch U5B 248*b* pin 6 to be Low. When RESET 203 goes Low due to a detected triggering motion, the charge on C11 254 and pin 1 prohibits any changes on the amplifier output pin RO 202 from being relayed to U5B 248*b* until the charge on C11 254 bleeds off through R21 256 and RESET goes Low. This process takes about 30 mS.

As shown in FIG. 15, the exemplary amplifier and detector unit 250 is a high gain, high selectivity, infrared light receiver that is tuned to detect an emission beam 24. The amplifier and detector unit 250 includes or references photo diodes PD1–PD5 222*a–d* and 223, L1BOARD 225, U1 (shown as U1A 258*a* and U1B 258*b*), U2 (shown as U2A 260*a* and U2B 260*b*), Q1 262, and associated components. U4C 246*c* and U4D 246*d* provide the logic to disable or enable the +4 volt power supply I.C. U3 209. U3 209 is a logic controlled, 6 pin, low drop out, series pass voltage regulator. The U3 209 takes 9 volt battery 205 (FIG. 14) voltage (8.2V to 4.2 V range) and produces 4 volts of regulated power used to power the amplifier and detector unit 250. The amplifier and detector unit 250 draws about 7 mA when active.

Reverse biased, radial-placed photo diodes PD1–PD4 222*a–d* look out through the target cover 210 in four directions. PD5 223 looks downward through the battery cover 218. An emission beam 24 striking any one of these beam sensors 28 will cause photo conduction, causing a small amounts of current to flow developing a small voltage across L1BOARD 225 and the input pin 3 of U1A 258*a*.

U2B 260*b* is used to produce a reference voltage, Vreff 264, equal to ½ of the supply voltage and separate from other power supplying energy sources. This allows operational amplifiers U1A 258*a*, U1B 258*b*, and U2A 260*a* to be biased to operate in their most linear range and provide a low impedance, low noise reference for the beam sensors 28 to work against.

As discussed above, tuning board L1BOARD 225 (FIG. 17) includes two capacitors C1 240*a* and C2 240*b* and one tunable inductor L1 208 which form a parallel resonant circuit tuned to 38 KHz. This resonate circuit is connected between Vreff 264 and the output PDO 266 from the beam sensors 28. The circuit has an impedance (Q) of about 60 at its resonance frequency of 38 KHz. At resonance, the impedance across L1 208, C1 240*a*, C2 240*b* is approximately 66K ohms. At all other frequencies (including DC) the impedance appears to be much lower. The magnitude of the voltage appearing between U1A 258*a* and Vreff 264 is the product of the impedance of L1 208, C1 240*a*, C2 240*b* and the current output PDO 266 from the beam sensors 28.

U1A 258*a* is configured as a non-inverting bandpass amplifier with a voltage gain of approximately 45 at 38 KHz (excluding loading affects created by gain inverting gain stage U1B). U1B 258*b* is configured as an inverting bandpass amplifier with a voltage gain of approximately 45. The two stages combine to amplify a 148 micro volt signal by about 2,000 times. A detected emission beam 24 of 148 micro volts would have an amplified value of 0.3 volts peak-to-peak or more. Diodes D1 268*a* and D2 268*b* limit the output swings of U1B 258*b* to 1 volt peak-to-peak.

Resistor R6 conducts the output of U1B 258*b* to U2A 260*a*. U2A 260*a* is configured as an inverting comparator. The output of U2A 260*a* remains Low, near 0.050 volts, until the negative voltage excursions of the amplified photo diodes signals exceed 150 mV below Vreff 264. The output of U2A 260*a* switches between 0.05 V and 3.50 V with signal amplitudes on U2A 260*a* of 0.3 volts peak-to-peak or greater. Low pass filter 270 integrates this signal and applies the integrated signal to the base of Q1 262. Q1 262 remains non-conducting until its base-to-emitter voltage exceeds about 0.6 volts. As shown, a pulse train of 38 KHz IR signal, such as the preferred emission beam 24, must be received for at least 1 mS (as shown the emission beam 24 has a burst lasting approximately 6 mS) for the base voltage of Q1 262 to equal or exceed 0.6 volts. When the appropriate emission beam 24 is received, the Q1 262 collector pin, the receiver output pin RO 202, is pulled Low.

Pattern Testing Board

As shown in FIGS. 18–21, an auxiliary component of the simulation system is a pattern testing board 300 that can detect and display the actual pattern of the emission beam 24 emanating from the beam choke 21. By displaying the actual beam pattern, firearm operation and shot pattern can be verified. To do this, the pattern testing board 300 is placed at a distance of 35 yards from the shooter either behind the target catch net or to the side. One or more shooters can sight and shoot at the pattern testing board 300. The pattern testing board 300 will display a pattern representative of the shape of the emission beam 24 at 35 yards.

Figure 19:
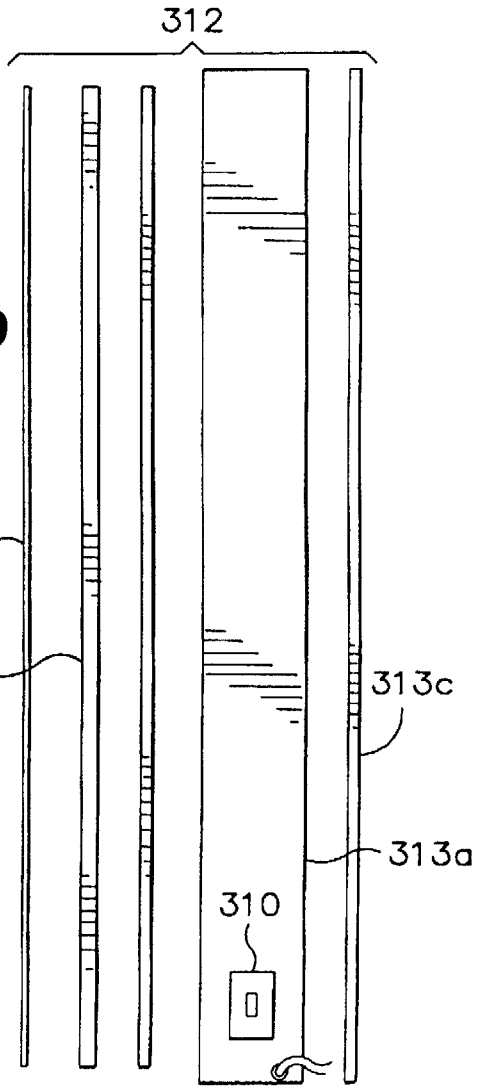
FIG. 19 is a side view of the pattern testing board.
Figure 18:
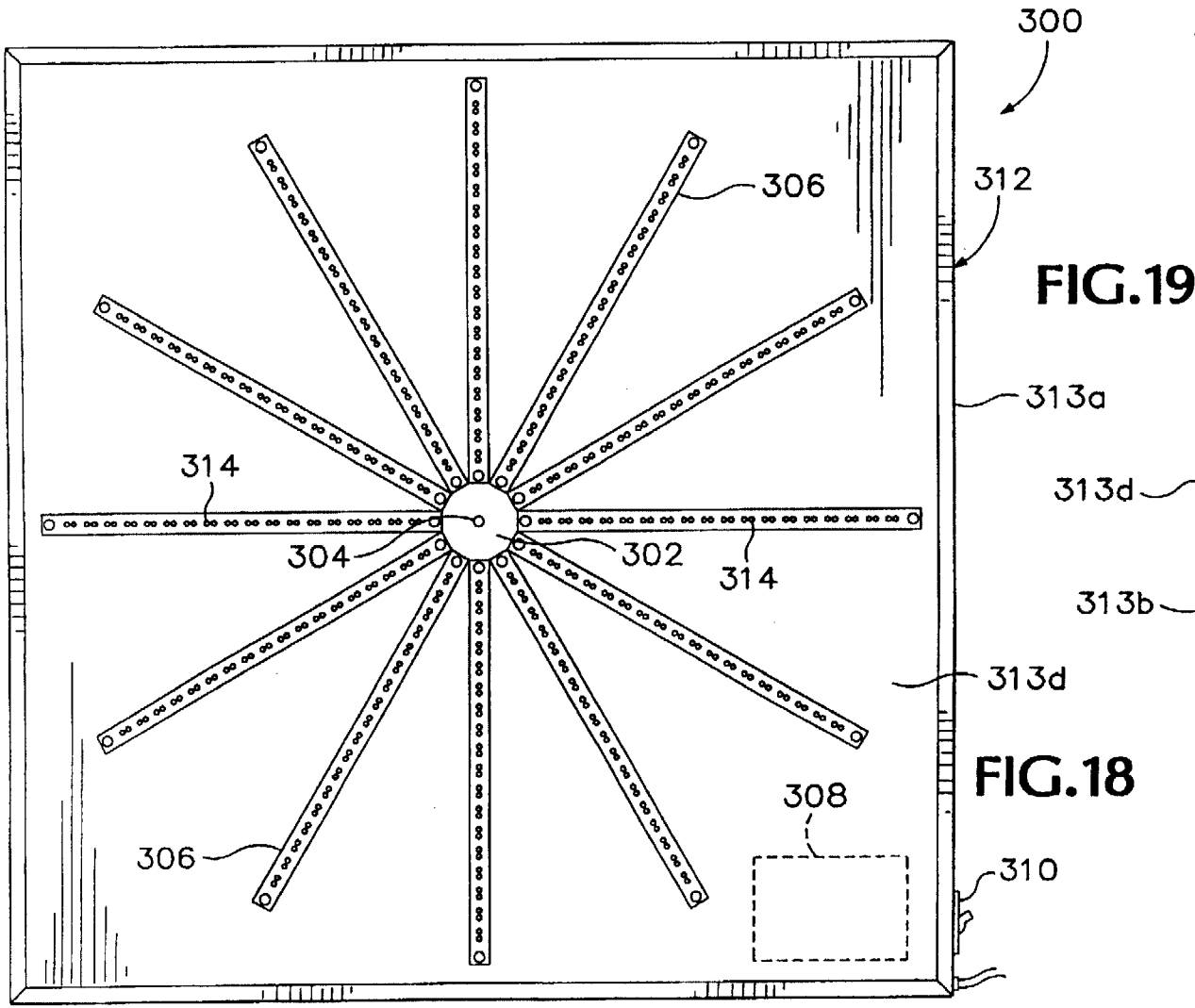
FIG. 18 is a front view of a pattern testing board.
Figure 20:
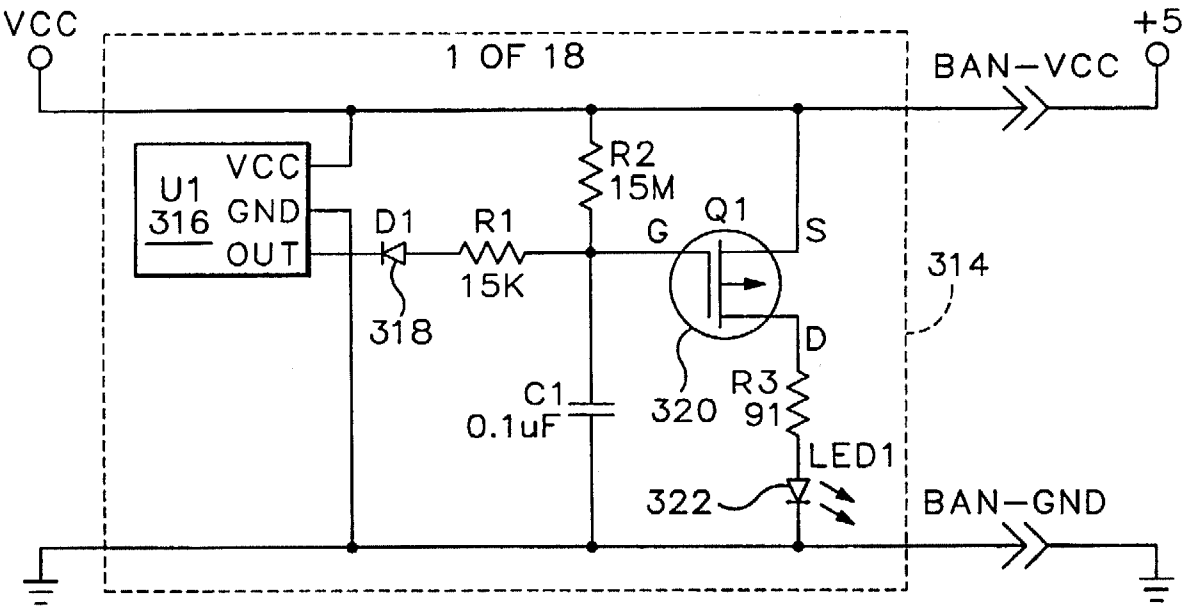
FIG. 20 is a circuit diagram of an infrared detection IC/amplifier/LED circuit on the box PWB.
Figure 21:
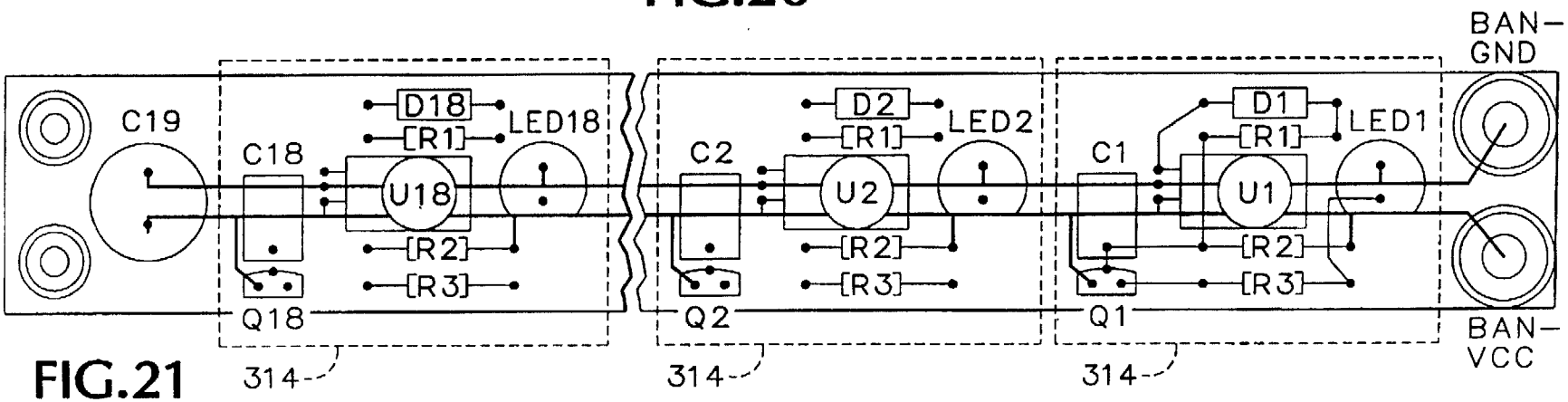
FIG. 21 is a partial simplified diagram of a box printed wiring board of the pattern testing board.

As shown in FIGS. 18–19, one embodiment of the pattern testing board 300 consists of a central target disk 302 with central box LED 304, a plurality of box printed wiring boards (PWBs) 306 which are preferably arranged radially around the box LED 304, a power source 308, an ON/OFF switch 310, and an enclosing case 312. Each of the box PWBs 306 contain a set (shown as 18) of IR detection IC/amplifier/LED circuits 314 (FIG. 20) that are spaced 1" apart.

An exemplary case or housing 312 of the pattern testing board 300 is shown in FIG. 19. The housing 312 may be constructed of any sturdy building material such as wood or metal. The example shown includes case components such as an exterior frame 313*a*, an inset panel 313*b* for mounting the box PWBs 306 and central target disk 302, a back cover 313*c*, as well as additional braces. The pattern testing board 300 may also include a polycarbonate front sheet 313*d* to protect the electronic circuitry from damage.

As shown in the exemplary embodiment of FIGS. 18 and 19, a power source 308 (shown in phantom) that is connected to conventional 120 $V_{AC}$ power may be mounted on the inside, bottom of the pattern testing board 300. Each of the box PWBs 306, that are preferably spaced radially about a central box LED 304, are each electrically connected to the power source 308. Preferably the central target disk 302 is also connected to the power source 308 so that the central box LED 304 is illuminated when the pattern testing board 300 is receiving power. The illuminated central box LED 304 also draws the shooter's attention to the center of the pattern testing board 300. As shown in FIG. 18, the array pattern is 40" in diameter and has 216 detection sites. The ON/OFF switch 310 may be a conventional wall switch that is mounted on the side of the housing 312.

When a beam detection IC/amplifier/LED circuit 314 is illuminated by an emission beam 24 pulsing at a predefined rate for a duration of 1 to 8 milliseconds, the associated LED lights up for a duration of approximately 2 seconds. The resulting display of lit LEDs indicates the location and pattern of the emission beam 24 on the pattern testing board 300. Each of the box PWBs 306 includes a set of beam detection IC/amplifier/LED circuits 314 such as those shown in FIG. 20. As shown, each circuit 314 includes a photo IC (U1) 316 which is a high sensitivity, photo diode, and bandpass amplifier in a single integrated circuit package that is sensitive to the emission beam 24.

Turning to the electronics, when the output of U1 316 is High (not illuminated), diode D1 318 is non-conducting, P channel MOSFET (Q1) 320 is non-conducting, C1 has been charged to $V_{cc}$ by R2, and Q1 drain (D), R3, and LED1 are at ground potential. When the output of U1 316 goes Low (illumination detected), D1 318 conducts which brings the D1 anode junction with R1 to about 1 volt above ground. If the output of U1 316 remains Low, the voltage across C1 decreases from $V_{cc}$ to +1 volt. As the voltage across C1 decreases, the source-to-gate voltage of Q1 320 increases causing Q1 320 to conduct when the voltage difference exceeds 2 volts. With the Q1 source at +5 volts and the Q1 gate at +1 volt, Q1 source-to-drain (D) resistance appears to be under 10 ohms. With Q1 320 conducting, R3 will pull LED1 322 anode High until LED1 322 begins conducting at+1.6 volts. LED1 322 will remain illuminated as long as U1 316 output is Low. When U1 $V_{out}$ returns to High, D1 318 becomes reversed biased and ceases to conduct. However, the voltage across C1 proceeds to increase from+1V to $V_{cc}$ due to the current supplied by R2. As the voltage across C1 increases the gate-to-source voltage of Q1 320 decreases. Q1 source-to-drain resistance increases until Q1 320 ceases to conduct depriving LED1 322 of all illumination. R2 and C1 form a time constant of about 1.5 seconds resulting in current flow through LED1 322 for about 2 seconds after U1 $V_{out}$ goes High. This procedure causes LED1 322 to remain visible for approximately 2 seconds after being triggered. Other features of the circuitry include the fact that R1 and C1 form a low pass filter to reject quick, short duration excursion of $U1_{out}$ Low caused by noise. R1 also limits the surge in current that would occur if D1 318 were directly connected to C1.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A simulation system for simulating shooting sports using a standard firearm having an ammunition chamber, a barrel, and a firing pin, said simulation system comprising:

(a) a non-projectile ammunition transmitter system comprising:

(i) an actuating beam cartridge for insertion into said ammunition chamber, said beam cartridge including a first beam emitter responsive to said firing pin, said first beam emitter for emitting a first triggering beam; and (ii) a beam choke mounting to said barrel, said beam choke including a second beam emitter responsive to said first triggering beam, said second beam emitter for emitting a second triggering beam; and (b) a self-contained reusable target receiver system suitable for launching having at least one beam sensor and at least one hit indicator responsive to said beam sensor's sensing of said second triggering beam, said target receiver system has a sleep state and an enabled state, said target receiver system including an arming mechanism, sensitive to motion, for converting said target receiver system from said sleep state to said enabled state.

2. The simulation system of claim 1 wherein said transmitter system is for retrofitting to said firearm.

3. The simulation system of claim 1, said beam choke for insertion into said barrel.

4. The simulation system of claim 1, said beam choke including a variable lens system.

5. The simulation system of claim 1 wherein said second beam emitter delays emitting said second triggering beam in response to said first triggering beam.

6. The simulation system of claim 1 for simulating shooting sports featuring a launchable target, said target receiver system having dimensions comparable to that of said launchable target so as to be launchable by the same apparatus used for launching said launchable target.

7. The simulation system of claim 1 wherein said at least one beam sensor of said target receiver system is for discriminating between said second triggering beam and ambient light.

8. The simulation system of claim 1 wherein said receiver system is enclosed in a durable casing comprising:

(a) a chassis having a top surface, a bottom surface, and an annular periphery;

(b) a cover secured to said top surface of said chassis;

(c) an external cushion ring secured to said annular periphery of said chassis; and (d) a battery cover secured to said bottom surface of said chassis.

9. A transmitter system for transmitting an emission beam, said transmitter system for use with a firearm having a triggering mechanism, said transmitter system comprising:

(a) an actuator responsive to said triggering mechanism, said actuator comprising:

(i) a case enclosing a firing sphere, a spring, and a switch;

(ii) said firing sphere responsive to said triggering mechanism; and (iii) said spring positioned between said firing sphere and said switch, said spring responsive to said firing sphere;

(iv) wherein said switch is activated when said spring is compressed by said firing sphere after said firing sphere is struck by said triggering mechanism;

(b) a first beam emitter responsive to said actuator, said first beam emitter emitting an actuating beam; and (c) a second beam emitter responsive to said actuating beam, said second beam emitter emitting an emission beam.

10. The transmitter system of claim 9, said actuator and said first beam emitter for insertion into an ammunition chamber of said firearm and said second beam emitter for insertion into a barrel of said firearm.

11. The transmitter system of claim 9 wherein said emission beam is a laser beam.

12. The transmitter system of claim 9 wherein said emission beam is a beam of light.

13. The transmitter system of claim 9 wherein said actuator and said first beam emitter are remote from said second beam emitter.

14. The transmitter system of claim 9 wherein said actuating beam is a beam of light, said second beam emitter further comprising a beam sensor for sensing said beam of light.

15. The transmitter system of claim 9 wherein said actuating beam is a laser beam, said second beam emitter further comprising a beam sensor for sensing said laser beam.

16. The transmitter system of claim 9, said actuator further comprising:

(a) a light-emitting diode, said light-emitting diode responsive to said switch; and (b) said beam emitter responsive to light emitted from said light-emitting diode.

17. The transmitter system of claim 9, said actuator further comprising:

(a) a laser-emitting diode, said laser-emitting diode responsive to said switch; and (b) said second beam emitter responsive to laser emitted from said laser-emitting diode.

18. The transmitter system claim 9, said second beam emitter including a lens systems.

19. The transmitter system of claim 9, said second beam emitter including a variable lens system.

20. The transmitter system of claim 19, said variable lens system including a diverging lens and a converging lens.

21. The transmitter system of claim 19, said variable lens system including a fixed lens and a movable lens.

22. The transmitter system of claim 21 wherein said movable lens is rotated on a variable choke grip to adjust said emission beam.

23. The transmitter system of claim 21 wherein shim spacers are inserted between said fixed lens and said movable lens to adjust said emission beam.

24. The transmitter system of claim 9 wherein said second beam emitter is for seating in a barrel of said firearm in a seated position.

25. The transmitter system of claim 24 wherein said second beam emitter is frictionally held in said seated position.

26. The transmitter system of claim 24 wherein said second beam emitter is magnetically held in said seated position.

27. The simulation system of claim 9 wherein said second beam emitter delays emitting said emission beam in response to said actuating beam.

28. A receiver system for receiving an emission beam, said receiver system suitable for launching, said receiver system comprising:

(a) at least one motion detector responsive to a triggering motion;

(b) at least one emission beam sensor responsive to an emission beam; and (c) at least one hit indicator responsive to said emission beam sensor sensing said emission beam;

(d) wherein said emission beam sensor is activated and said hit indicator is enabled by said motion detector detecting said triggering motion.

29. The receiver system of claim 28, said at least one motion detector responsive to acceleration.

30. The receiver system of claim 28, including a timer for deactivating said emission beam sensor and for disabling said hit indicator after a predefined time.

31. The receiver system of claim 28, said emission beam sensor including a deactivator responsive to said emission beam sensor sensing said emission beam and said hit indicator including a disabler responsive to said emission beam sensor sensing said emission beam.

32. The receiver system of claim 28, said receiver system having a first state in which said hit indicators are enabled and a second state in which said hit indicators are disabled, said receiver system having means for switching between said first state and said second state.

33. The receiver system of claim 32 wherein said hit indicators are illuminated when enabled and dark when disabled.

34. The receiver system of claim 32 wherein said receiver system enters said first state in response to said motion detector detecting said triggering motion.

35. The receiver system of claim 32 wherein said receiver system enters said second state in response to said emission beam sensor sensing said emission beam.

36. The receiver system of claim 32 wherein said receiver system enters said second state after a predefined period of time.

37. The receiver system of claim 28 wherein said motion detector, said emission beam sensor, and said hit indicator are enclosed in a case, said case having a shape suitable for launching by a launcher.

38. The receiver system of claim 28 enclosed in a durable casing, said durable casing comprising:

(a) a chassis having a top surface, a bottom surface, and an annular periphery; and (b) a cushion ring secured to said annular periphery of said chassis.

39. The receiver system of claim 38, said cushion ring having an inner ring, an outer ring, and a plurality of flexible braces each connecting said inner ring to said outer ring.

40. The receiver system of claim 38, including a cover secured to said top surface of said chassis.

41. The receiver system of claim 38, including a battery cover secured to said bottom surface of said chassis.

42. The receiver system of claim 38 said receiver system suitable for launching.

43. A receiver system for receiving an emission beam and suitable for launching, said receiver system comprising:

(a) at least one emission beam sensor responsive to an emission beam;

(b) at least one hit indicator responsive to said emission beam sensor sensing said emission beam; and (c) a durable casing enclosing said at least one emission beam sensor and said at least one hit indicator, said casing comprising:

(i) a chassis having a top surface, a bottom surface, and an annular periphery; and (ii) a cushion ring secured to said annular periphery of said chassis, said cushion ring having an inner ring, an outer ring, and a plurality of flexible braces each connecting said inner ring to said outer ring.

44. The receiver system of claim 43, including a cover secured to said top surface of said chassis.

45. The receiver system of claim 43, including a battery cover secured to said bottom surface of said chassis.

46. A simulation system for simulating shooting sports using a standard firearm having an ammunition chamber, a barrel, and a firing pin, said simulation system comprising:

(a) a non-projectile ammunition transmitter system responsive to said firing pin, said transmitter system including a beam emitter;

(b) a self-contained reusable target receiver system suitable for launching comprising:

(i) at least one motion detector responsive to a triggering motion;

(ii) at least one emission beam sensor responsive to an emission beam; and (iii) at least one hit indicator responsive to said emission beam sensor sensing said emission beam;

(iv) wherein said emission beam sensor is activated and said hit indicator is enabled by said motion detector detecting said triggering motion.

* * * * *

UNITED STATES PATENT AND TRADEMARK OFFICE

CERTIFICATE OF CORRECTION

PATENT NO. : 5,716,216

DATED : February 10, 1998

INVENTOR(S) : LightShot Systems, Inc.

It is certified that error appears in the above-identified patent and that said Letters Patent is hereby corrected as shown below:

ON THE TITLE PAGE:
Item [75] Inventors: "George R. Hull" should be listed as First Inventor.
Item [19] "O'Loughlin et al." should read --Hull et al.--.

| | | |
|---|---|---|
| Col. 7, | Line 59: | Delete "5" before "PWB". |
| Col. 18, | Line 24 | Delete "24c" and insert --248c--. |
| Col. 19, | Line 2 | Delete "a" before "small amounts". |
| Col. 21, | Line 27 | Insert --for-- before "mounting". |

Signed and Sealed this

Twenty-fourth Day of November, 1998

*Attest:*

Bruce Lehman

BRUCE LEHMAN

*Attesting Officer*

*Commissioner of Patents and Trademarks*